US010336063B2

(12) United States Patent
Bando et al.

(10) Patent No.: US 10,336,063 B2
(45) Date of Patent: Jul. 2, 2019

(54) LIQUID DISCHARGE APPARATUS, LIQUID DISCHARGE SYSTEM, AND LIQUID DISCHARGE METHOD

(71) Applicants: Hanako Bando, Tokyo (JP); Koichi Kudo, Kanagawa (JP); Tsuyoshi Nagasu, Kanagawa (JP)

(72) Inventors: Hanako Bando, Tokyo (JP); Koichi Kudo, Kanagawa (JP); Tsuyoshi Nagasu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/657,595

(22) Filed: Jul. 24, 2017

(65) Prior Publication Data

US 2018/0022088 A1 Jan. 25, 2018

(30) Foreign Application Priority Data

Jul. 25, 2016 (JP) ..... 2016-145701
Jul. 4, 2017 (JP) ..... 2017-131460
Jul. 13, 2017 (JP) ..... 2017-137301

(51) Int. Cl.
*B41J 2/045* (2006.01)
*B41J 11/42* (2006.01)
*B41J 11/00* (2006.01)

(52) U.S. Cl.
CPC ..... *B41J 2/04508* (2013.01); *B41J 2/04586* (2013.01); *B41J 11/0095* (2013.01); *B41J 11/42* (2013.01)

(58) Field of Classification Search
CPC ..... B41J 11/0095; B41J 25/001; B41J 25/04505; B41J 11/008; B41J 3/543; B41J 2/2135; G03G 15/5054
See application file for complete search history.

(56) References Cited

U.S. PATENT DOCUMENTS

2005/0185009 A1* 8/2005 Claramunt ..... B41J 2/435 347/16
2009/0002424 A1* 1/2009 Kiyama ..... B41J 3/543 347/16
2010/0310284 A1 12/2010 Funato et al.
(Continued)

FOREIGN PATENT DOCUMENTS

JP 2014-035197 2/2014

OTHER PUBLICATIONS

U.S. Appl. No. 15/455,539, filed Mar. 10, 2017.
U.S. Appl. No. 15/456,677, filed Mar. 13, 2017.

*Primary Examiner* — John Zimmermann
(74) *Attorney, Agent, or Firm* — Harness, Dickey & Pierce, P.L.C.

(57) ABSTRACT

A liquid discharge apparatus includes a head to discharge liquid onto a conveyed object, at least one light source to irradiate the conveyed object with light having a high relative intensity in a range of wavelength in which a relative reflectance of the liquid is high, and a detector including at least one optical sensor to perform imaging of the conveyed object being irradiated by the at least one light source, to generate data. The detector is configured to generate a detection result based on the data. The detection result including at least one of a conveyance amount of the conveyed object and a conveyance speed of the conveyed object.

16 Claims, 25 Drawing Sheets

(56) References Cited

U.S. PATENT DOCUMENTS

| | | | | |
|---|---|---|---|---|
| 2014/0044460 | A1 | 2/2014 | Kudo et al. | |
| 2014/0219670 | A1 | 8/2014 | Masuda et al. | |
| 2014/0268180 | A1 | 9/2014 | Takaura et al. | |
| 2015/0009262 | A1 | 1/2015 | Bell et al. | |
| 2016/0114576 | A1 | 4/2016 | Tobita | |
| 2016/0121602 | A1 | 5/2016 | Nagasu et al. | |
| 2016/0136947 | A1 | 5/2016 | Hommi | |
| 2016/0332459 | A1* | 11/2016 | Ohnishi | B41J 2/2132 |
| 2016/0347050 | A1 | 12/2016 | Hommi | |
| 2017/0057258 | A1* | 3/2017 | Otsuka | B41J 13/0009 |
| 2017/0106647 | A1 | 4/2017 | Inoue | |
| 2017/0165960 | A1 | 6/2017 | Sunaoshi et al. | |
| 2017/0165961 | A1 | 6/2017 | Hayashi et al. | |
| 2017/0182764 | A1 | 6/2017 | Nagasu et al. | |

* cited by examiner

LIQUID DISCHARGE APPARATUS, LIQUID DISCHARGE SYSTEM, AND LIQUID DISCHARGE METHOD

CROSS-REFERENCE TO RELATED APPLICATION

This patent application is based on and claims priority pursuant to 35 U.S.C. § 119(a) to Japanese Patent Application Nos. 2016-145701, filed on Jul. 25, 2016, 2017-131460, filed on Jul. 4, 2017, and 2017-137301, filed on Jul. 13, 2017, in the Japan Patent Office, the entire disclosure of each of which is hereby incorporated by reference herein.

BACKGROUND

Technical Field

This disclosure relates to a liquid discharge apparatus, a liquid discharge system, and a liquid discharge method.

Description of the Related Art

There are image forming methods that include discharging ink from a print head (so-called inkjet methods). To improve the quality of images formed on recording media, such image forming methods include, for example, adjusting the position of the print head relative to the recording media.

SUMMARY

According to an embodiment of this disclosure, a liquid discharge apparatus includes a head to discharge liquid onto a conveyed object, at least one light source to irradiate the conveyed object with light having a high relative intensity in a range of wavelength in which a relative reflectance of the liquid is high, and a detector including at least one optical sensor to perform imaging of the conveyed object being irradiated by the at least one light source, to generate image data. The detector is configured to generate a detection result based on the image data. The detection result including at least one of a conveyance amount of the conveyed object and a conveyance speed of the conveyed object.

According to another embodiment, a system includes the above-described liquid discharge apparatus and a host configured to input image data and control data to the liquid discharge apparatus.

According to another embodiment, a liquid discharge apparatus includes a head to discharge liquid onto a conveyed object. The head moves in an orthogonal direction orthogonal to a conveyance direction of the conveyed object. The liquid discharge apparatus further includes a first light source disposed upstream from the head in the conveyance direction, to irradiate the conveyed object, a second light source disposed downstream from the head in the conveyance direction, to irradiate the conveyed object with light having a high relative intensity in a range of wavelength in which a relative reflectance of the liquid is high, and a detector. The detector includes a first optical sensor configured to perform imaging of the conveyed object being irradiated by the first light source, to generate first image data, and a second optical sensor configured to perform imaging of the conveyed object being irradiated by the second light source, to generate second image data. The detector is configured to generate a detection result based on the first image data and the second image data. The detection result includes at least one of a conveyance amount of the conveyed object and a conveyance speed of the conveyed object.

According to another embodiment, a liquid discharging method includes discharging liquid onto a conveyed object, irradiating the conveyed object with light having a high relative intensity in a range of wavelength in which a relative reflectance of the liquid is high, generating image data of an irradiated portion of the conveyed object and generating a detection result based on the image data, the detection result including at least one of a conveyance amount of the conveyed object and conveyance speed of the conveyed object.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
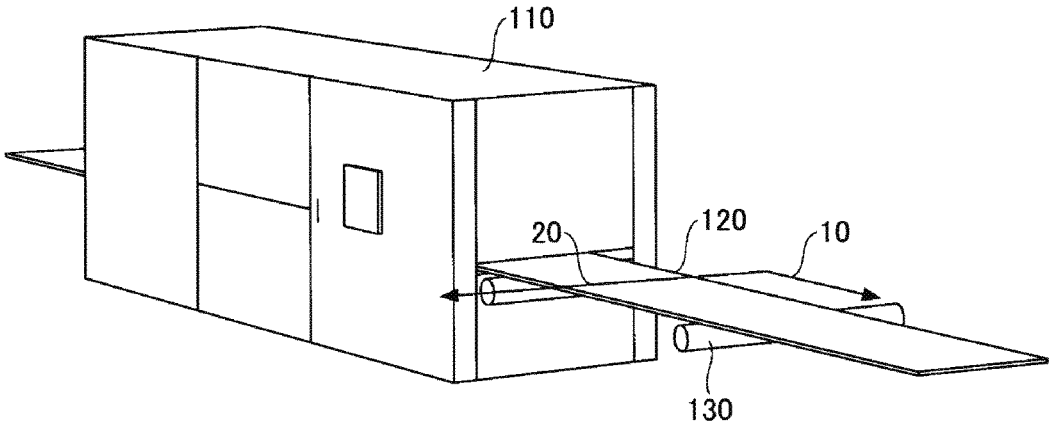
FIG. 1 is a schematic view of a liquid discharge apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

General Configuration

FIG. 1 is a schematic view of a liquid discharge apparatus according to an embodiment. For example, the liquid discharge apparatus is an image forming apparatus having a structure illustrated in FIG. 1. In an image forming apparatus 110 illustrated in FIG. 1, the liquid to be discharged is a recording liquid such as aqueous ink or oil-based ink.

Examples of the conveyed object include recording media, such as a web 120. In the illustrated example, the image forming apparatus 110 includes a roller 130 and the like to convey the web 120, serving as a recording medium, and discharges liquid onto the web 120 to form an image thereon. The web 120 is a so-called continuous sheet. That is, the web 120 is, for example, paper in the form of a roll that can be reeled. The image forming apparatus 110 is a so-called production printer. The description below concerns an example in which the roller 130 adjusts the tension of the web 120 and conveys the web 120 in a conveyance direction 10. Hereinafter, unless otherwise specified, "upstream" and "downstream" mean those in the conveyance direction 10. A direction orthogonal to the conveyance direction 10 is referred to as an orthogonal direction 20. In the illustrated example, the image forming apparatus 110 is an inkjet printer to discharge four color inks, namely, black (K), cyan (C), magenta (M), and yellow (Y) inks, to form an image on the web 120.

Figure 2:
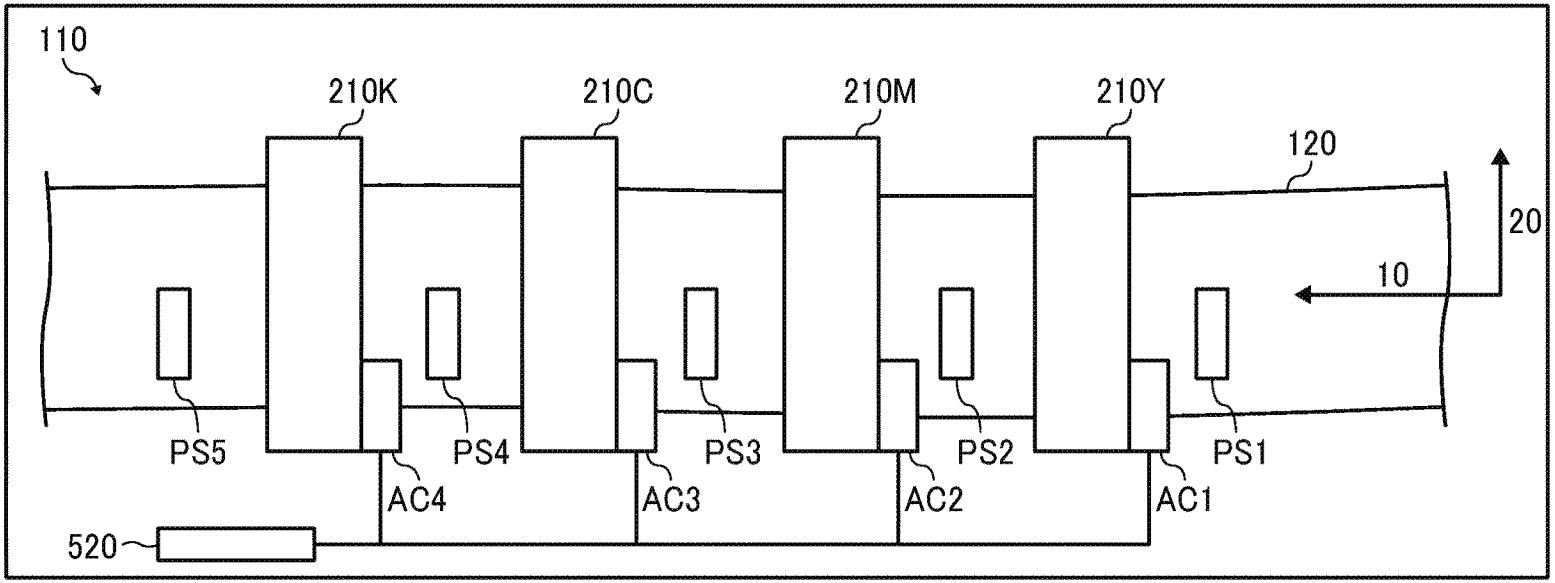
FIG. 2 is a plan view illustrating arrangement of sensor devices of the liquid discharge apparatus illustrated in FIG. 1.
Figure 3:
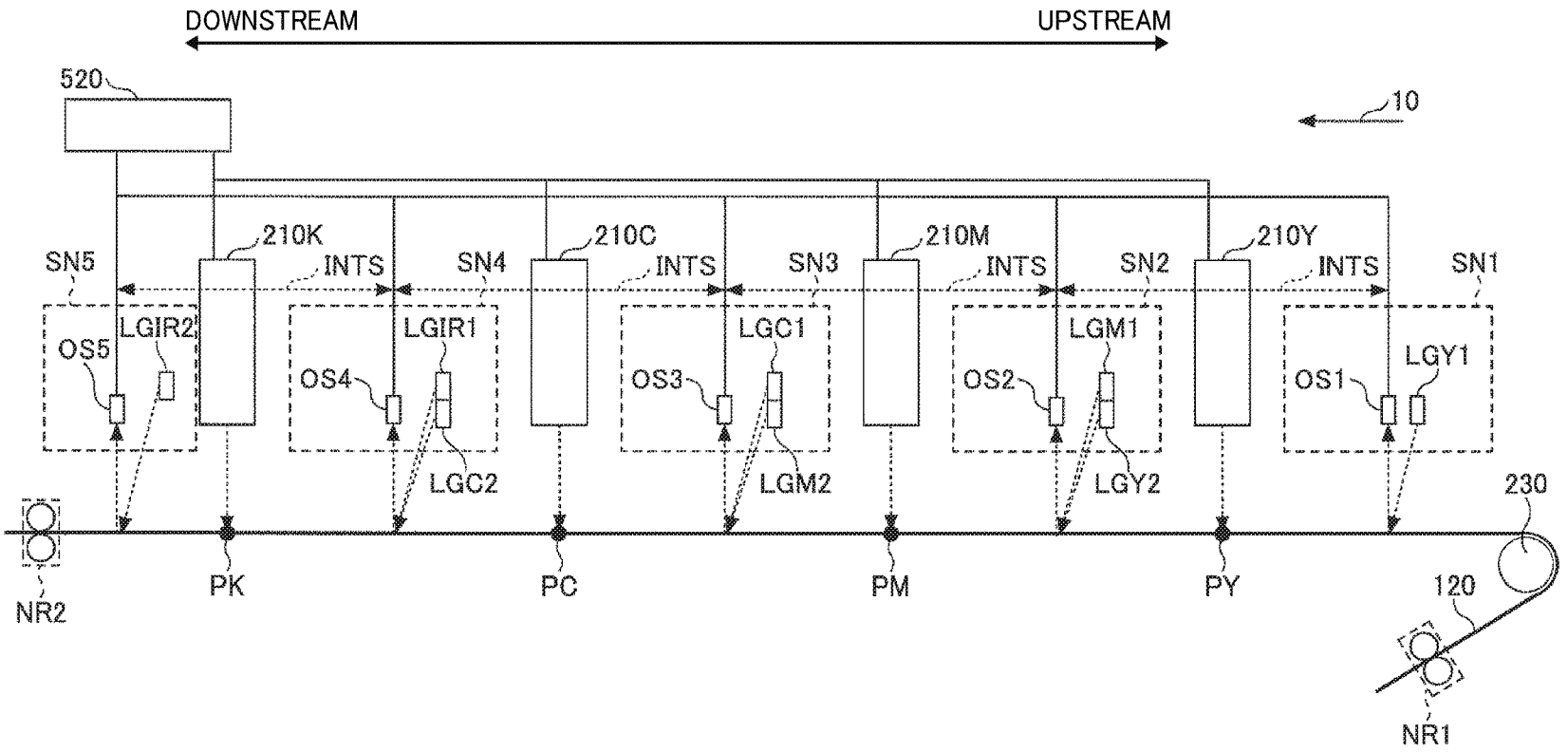
FIG. 3 is a schematic view illustrating a general structure of the liquid discharge apparatus illustrated in FIG. 1.

FIG. 2 is a schematic plan view illustrating an arrangement of sensor devices in the image forming apparatus 110 as the liquid discharge apparatus according to an embodiment. FIG. 3 is a schematic view of the image forming apparatus 110 as viewed from a side. As illustrated in FIG. 2, the image forming apparatus 110 includes four liquid discharge head units 210 (210Y, 210M, 210C, and 210K) to discharge the four inks, respectively.

Each liquid discharge head unit 210 discharges the ink onto the web 120 conveyed in the conveyance direction 10. The image forming apparatus 110 includes two pairs of nip rollers, a roller 230, and the like, to convey the web 120. One of the two pairs of nip rollers is a first nip roller pair NR1 disposed upstream from the liquid discharge head units 210 in the conveyance direction 10. The other is a second nip roller pair NR2 disposed downstream from the first nip roller pair NR1 and the liquid discharge head units 210 in the conveyance direction 10. Each nip roller pair rotates while nipping the conveyed object, such as the web 120, as illustrated in FIG. 3. The nip roller pairs and the roller 230 together convey the conveyed object (e.g., the web 120) in a predetermined direction.

The recording medium such as the web 120 is a continuous sheet. Specifically, the recording medium is preferably longer than the distance between the first nip roller pair NR1 and the second nip roller pair NR2. The recording medium is not limited to webs. For example, the recording medium may be a folded sheet (so-called fanfold paper or Z-fold paper).

In the structure illustrated in FIGS. 2 and 3, the liquid discharge head units 210 are arranged in the order of yellow (Y), magenta (M), cyan (C), and black (K) from upstream to downstream in the conveyance direction 10. Specifically, the liquid discharge head unit 210K for black is disposed extreme downstream, and the liquid discharge head unit 210C for cyan is disposed next to the liquid discharge head unit 210K. Further, the liquid discharge head unit 210M for magenta is disposed next to the liquid discharge head unit 210C for cyan, and the liquid discharge head unit 210Y for yellow is disposed extreme upstream in the conveyance direction 10.

Note that, regarding the order of colors, a color that absorbs light well is preferably disposed extreme downstream in illustrated in FIG. 2. The arrangement order of yellow, magenta, and cyan is not limited to the order illustrated in FIG. 2. For example, the liquid discharge head units 210 can be arranged in the order of yellow, cyan, magenta, and black.

Each liquid discharge head unit 210 discharges the ink to a predetermined position on the web 120, according to image data. The position at which the liquid discharge head unit 210 discharges ink (hereinafter "ink discharge position") is almost identical to the position at which the ink discharged from the liquid discharge head (e.g., 210K-1, 210K-2, 210K-3, or 210K-4 in FIG. 4A) lands on the recording medium. In other words, the ink discharge position can be directly below the liquid discharge head. In the present embodiment, black ink is discharged at the ink discharge position of the liquid discharge head unit 210K (hereinafter "black ink discharge position PK"). Similarly, cyan ink is discharged at the ink discharge position of the liquid discharge head unit 210C (hereinafter "cyan ink discharge position PC"). Magenta ink is discharged at the ink discharge position of the liquid discharge head unit 210M (hereinafter "magenta ink discharge position PM"). Yellow ink is discharged at the ink discharge position of the liquid discharge head unit 210Y (hereinafter "yellow ink discharge position PY").

Referring to FIG. 3, along the route of conveyance of the web 120, first, second, third, fourth, and fifth sensor devices SN1, SN2, SN3, SN4, and SN5 (collectively "sensor devices SN") are disposed. The sensor device SN constructs a detector according to an embodiment, to perform imaging of the recording media and generate image data. The sensor devices SN detect the recording medium (e.g., the web 120) in the orthogonal direction 20.

In FIG. 3, each of the first, second, third, fourth, and fifth sensor devices SN1, SN2, SN3, SN4, and SN5 includes an optical sensor OS (OS1, OS2, OS3, OS4, or OS5) and a light source LG (LGY1, LGY2, LGM1, LGM2, LGC1, LGC2, LGIR1, or LGIR2). For example, the optical sensor OS is a charge-coupled device (CCD) camera or a complementary metal oxide semiconductor (CMOS) camera. The optical sensor OS constructing the detector is a sensor capable of detecting a surface of the recording medium, in particular, during image formation, as described later.

In FIG. 3, the liquid discharge head unit 210 is interposed between two of first, second, third, fourth, and fifth optical sensors OS1, OS2, OS3, OS4, and OS5 in the conveyance direction 10. The optical sensors OS are preferably evenly spaced at intervals INTS in the conveyance direction 10, as illustrated in FIG. 3. Disposing the sensors OS at regular intervals INTS facilitates calculation using the interval INTS. However, the intervals between the optical sensors OS are not necessarily identical as long as the optical sensors OS are disposed at predetermined intervals, with the liquid discharge head unit 210 interposed between two of the optical sensors OS.

Each of the sensor devices SN includes, at least, one light source LG to irradiate a detection areas of the optical sensor OS. In FIG. 2, the first optical sensor OS1 disposed upstream from the liquid discharge head unit 210Y in the conveyance direction 10 is provided with the yellow light source LGY1. The second optical sensor OS2 disposed downstream from the liquid discharge head unit 210Y is provided with the yellow light source LGY2. That is, the first sensor device SN1 and the second sensor device SN2 include light sources configured to emit light having a high relative intensity in a range of wavelength reflected on the yellow ink (a range of wavelength in which relative reflectance of the yellow ink is high).

The second optical sensor OS2 disposed upstream from the liquid discharge head unit 210M in the conveyance direction 10 is also provided with the magenta light source LGM1. The third optical sensor OS3 disposed downstream from the liquid discharge head unit 210M is provided with the magenta light source LGM2. That is, the second sensor device SN2 and the third sensor device SN3 include light sources configured to emit light having a high relative intensity in a wavelength range in which relative reflectance of magenta ink, discharged from the liquid discharge head unit 210M, is high.

The third optical sensor OS3 is disposed upstream from the liquid discharge head unit 210C in the conveyance direction 10 also provided with the cyan light source LGC1. The fourth optical sensor OS4 disposed downstream from the liquid discharge head unit 210C is provided with the cyan light source LGC2. That is, the third sensor device SN3 and the fourth sensor device SN4 *r* include light sources configured to emit light having a high relative intensity in a wavelength range in which relative reflectance of cyan ink, discharged from the liquid discharge head unit 210C, is high.

The fourth optical sensor OS4 disposed upstream from the liquid discharge head unit 210K in the conveyance direction 10 is provided with the infrared light source LGIR1. The fifth optical sensor OSN5 disposed downstream from the liquid discharge head unit 210K is provided with then infrared light source LGIR2. That is, the fourth sensor device SN4 and the fifth sensor device SN5 include light sources configured to emit light having a high relative intensity in a wavelength range in which relative reflectance of black ink, discharged from the liquid discharge head unit 210K, is high. Note that, for example, a controller 520 operably connected to the liquid discharge head units 210 controls the respective timings of ink discharge of the liquid discharge head units 210 and actuators AC1, AC2, AC3, and AC4 (correctively "actuators AC) of the liquid discharge head units 210. Alternatively, the control of timing and moving of the heads can be performed by two or more controllers or a circuit, instead of the controller 520. The actuators AC are described later.

Referring to FIG. 2, when viewed in the direction vertical to the recording surface of the web 120, for example, the sensor device SN is preferably disposed at a position close to an end of the web 120 in the width direction and overlapping with the web 120. Each sensor device SN includes the light source LG to irradiate the web 120 with laser light or the like and the optical sensor OS for imaging of the range irradiated by the light source LG. The sensor devices SN1, SN2, SN3, SN4, and SN5 are disposed at positions PS1, PS2, PS3, PS4, and PS5 in FIG. 2, respectively. In the configuration illustrated in FIGS. 2 and 3, the controller 520 controls the actuators AC1, AC2, AC3, and AC4 to move the liquid discharge head units 210Y, 210M, 210C, and 210K, respectively, in the orthogonal direction 20 orthogonal to the direction of conveyance of the web 120.

In the configuration illustrated in FIG. 3, the sensor devices SN are on a side (upper side in FIG. 3) of the web 120 identical to the side on which the liquid discharge head units 210 perform the operation on the web 120.

The laser light emitted from the light source LG is diffused on the surface of the web 120, and superimposed diffusion waves interfere with each other, generating a pattern such as a speckle pattern. The optical sensor OS of the sensor device SN performs imaging of the pattern to generate image data. Based on the position change of the pattern captured by the optical sensor OS, the image forming apparatus 110 can obtain the amount by which the liquid discharge head unit 210 is to be moved and the timing of ink discharge from the liquid discharge head unit 210.

Additionally, in this structure, the liquid discharge head unit 210 and the sensor device SN can be disposed such that the operation area (e.g., the image formation area) of the liquid discharge head unit 210 overlaps, at least partly, with the detection range of the sensor device SN.

Figure 4A:
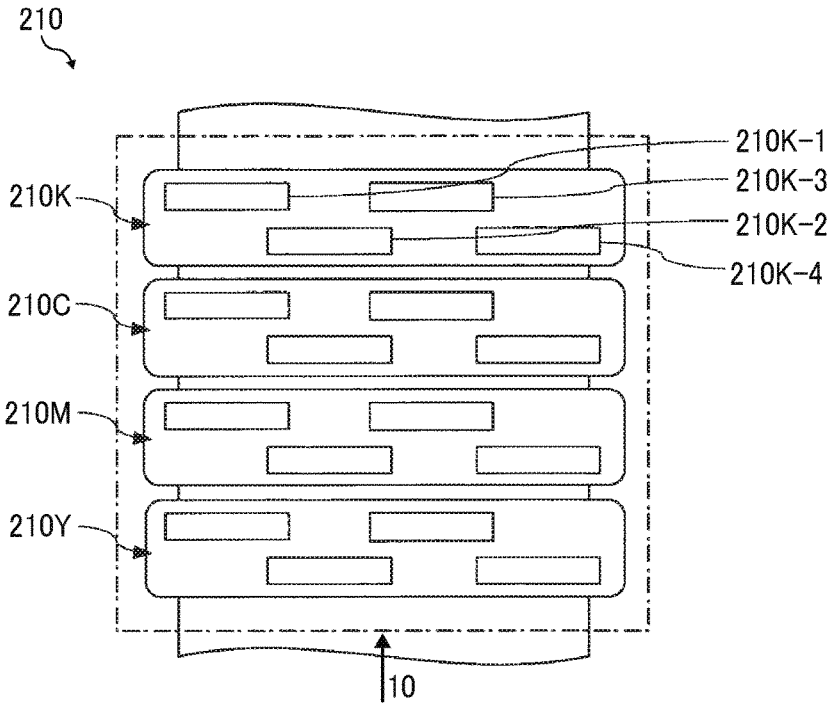
FIGS. 4A and 4B are schematic views illustrating external shape of a liquid discharge head unit according to an embodiment.
Figure 4B:
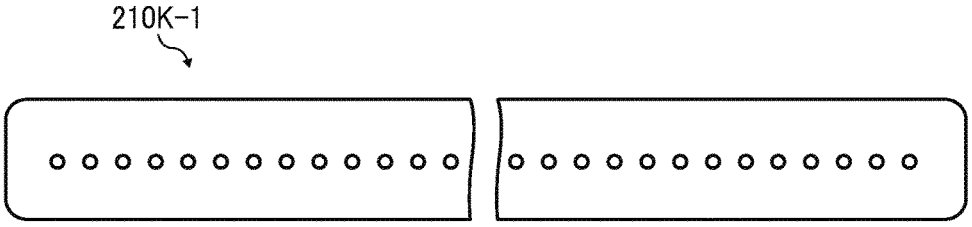

An example outer shape of the liquid discharge head unit 210 is described below with reference to FIGS. 4A and 4B. FIG. 4A is a schematic plan view of one of the four liquid discharge head units 210Y, 210M, 210C, and 210K of the image forming apparatus 110.

As illustrated in FIG. 4A, the liquid discharge head unit 210 according to the present embodiment is a line-type head unit. That is, the image forming apparatus 110 includes the four liquid discharge head units 210Y, 210M, 210C, and 210K arranged in that order in the conveyance direction 10.

The liquid discharge head unit 210K includes four heads 210K-1, 210K-2, 210K-3, and 210K-4 arranged in a staggered manner in the orthogonal direction 20. FIG. 4B illustrates the head 210K-1 from a nozzle side. With this arrangement, the image forming apparatus 110 can form an image across the image formation area on the web 120 in the width direction orthogonal to the conveyance direction 10. The liquid discharge head units 210C, 210M, and 210Y are similar in structure to the liquid discharge head unit 210K, and the descriptions thereof are omitted to avoid redundancy.

Although the description above concerns a liquid discharge head unit including four heads, a liquid discharge head unit including a single head can be used.

Figure 5:
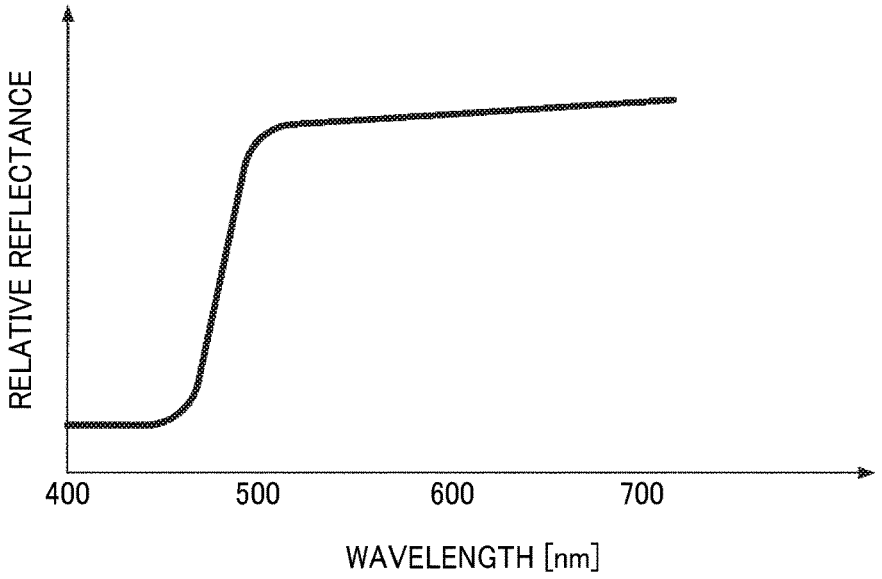
FIG. 5 is a graph of an example spectral reflectance property (relative reflectance) of yellow ink.

FIG. 5 is a graph of an example spectral reflectance property (relative reflectance) of yellow ink. In FIG. 5, the lateral axis represents the wavelength, and the vertical axis represents the relative reflectance of yellow ink at the wavelength.

In the example illustrated in FIG. 5, the yellow ink exhibits a high relative reflectance at a wavelength of light longer than about 500 nanometers. In other words, the yellow ink reflects well a wavelength of light longer than 500 nanometer. For the ink having such a property, the yellow light source LGY having the following spectral property is used in the present embodiment.

Figure 6:
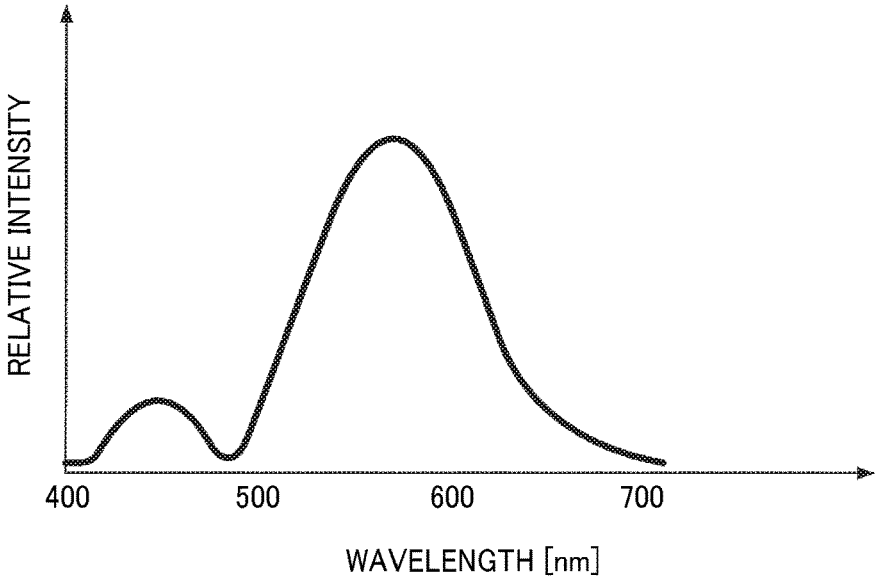
FIG. 6 is a graph of an example spectral property of a yellow light of the sensor device illustrated in FIG. 2.

FIG. 6 is a graph of an example spectral property of the yellow light source LGY (yellow light source LGY1 or LGY2). In this graph, the lateral axis represents the wavelength, and the vertical axis represents a relative intensity of light emitted from the light source LGY. An example of the yellow light source LGY is a yellow fluorescent light-emitting diode (LED). As illustrated, the yellow light source LGY emits relatively intense light at the wavelength longer than 500 nanometers.

The magenta ink is a colorant having the following spectral reflectance property, for example.

Figure 7:
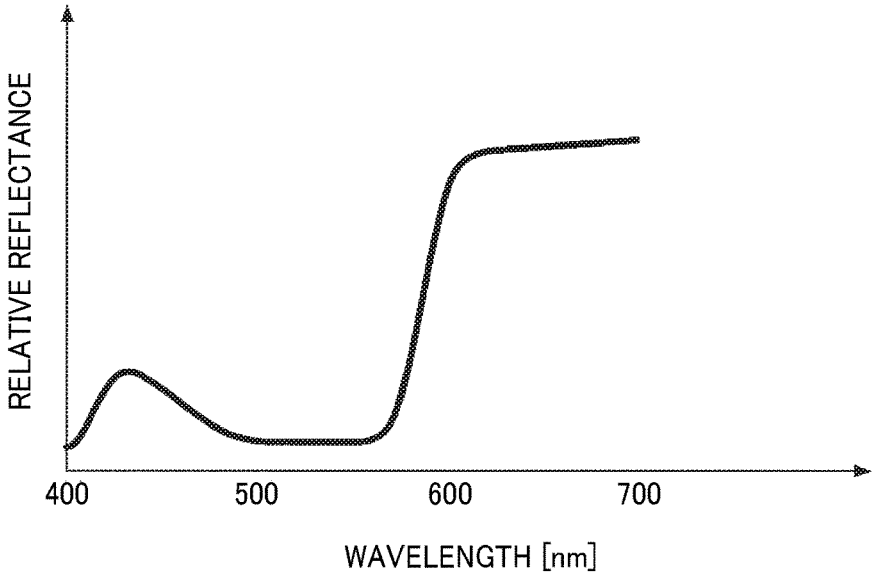
FIG. 7 is a graph of an example spectral reflectance property (relative reflectance) of magenta ink.

FIG. 7 is a graph of an example spectral reflectance property (relative reflectance) of magenta ink. In FIG. 7, the lateral axis represents the wavelength, and the vertical axis represents the relative reflectance of magenta ink at the wavelength.

In this example, the magenta ink exhibits a peak of the spectral reflectance at about 420 nanometer, and the spectral reflectance is higher at a wavelength of light longer than about 620 nanometers. In other words, the magenta ink reflects well a wavelength of light longer than 620 nanometer. For the ink having such a property, the magenta light source LGM is used to emit light having a spectral property in which the relative intensity is high in a wavelength range longer than 620 nanometer.

Note that any light source to emit light having a high relative intensity at a predetermined wavelength can be used. For the yellow ink and the magenta ink having the properties illustrated in FIGS. 5 and 7, for example, a red light source (e.g., a red LED) having the following property can be used instead.

Figure 8:
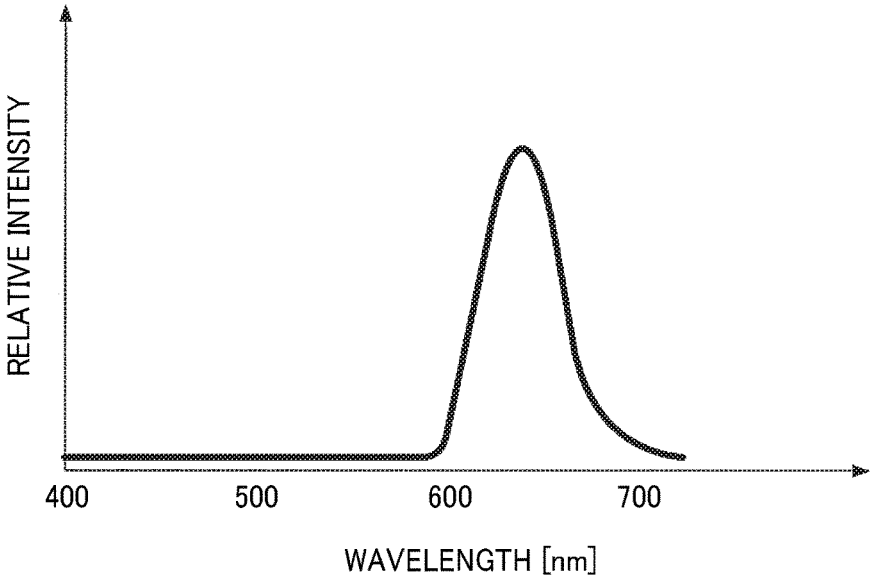
FIG. 8 is a graph of an example spectral property of a red light source of the sensor device illustrated in FIG. 2.

FIG. 8 is a graph of an example spectral property of the red light source. In this graph, the lateral axis represents the wavelength, and the vertical axis represents a relative intensity of light emitted from the light source. In the spectral property of the red light source illustrated in FIG. 8, the relative intensity has a peak at about 450 nanometers. In other words, the red light source irradiates, with relatively intense light, each of the yellow ink and the magenta ink having the properties illustrated in FIGS. 5 and 7, respectively. Such a light source is usable for the detection for yellow and the detection for magenta.

The cyan ink is a colorant having the following spectral reflectance property, for example.

Figure 9:
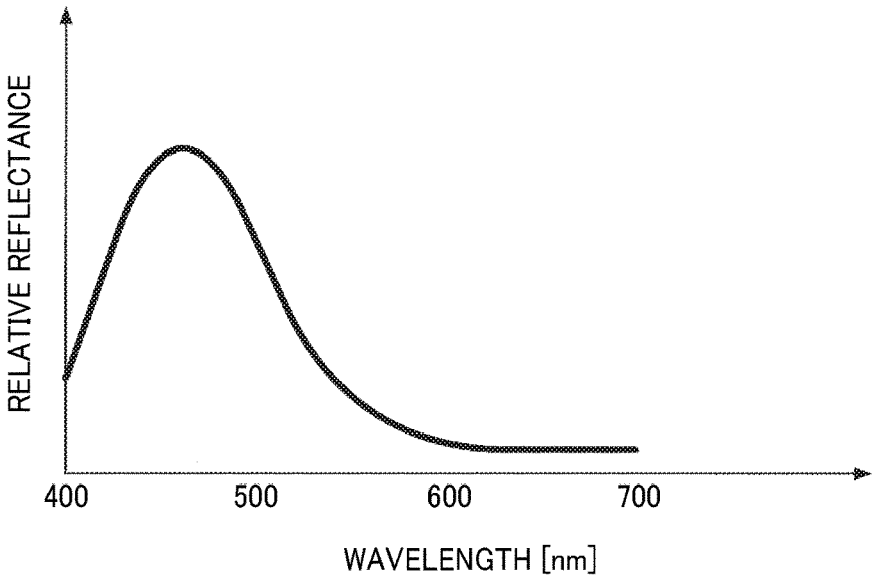
FIG. 9 is a graph of an example spectral reflectance property (relative reflectance) of cyan ink.

FIG. 9 is a graph of an example spectral reflectance property (relative reflectance) of cyan ink. In this graph, the lateral axis represents the wavelength, and the vertical axis represents the relative reflectance of cyan ink at the wavelength. In the example illustrated in FIG. 9, the cyan ink exhibits a peak of the spectral reflectance at about 450 nanometer.

For such cyan ink, a blue light source (e.g., an LED) having the following property is usable as the cyan light source LCG.

Figure 10:
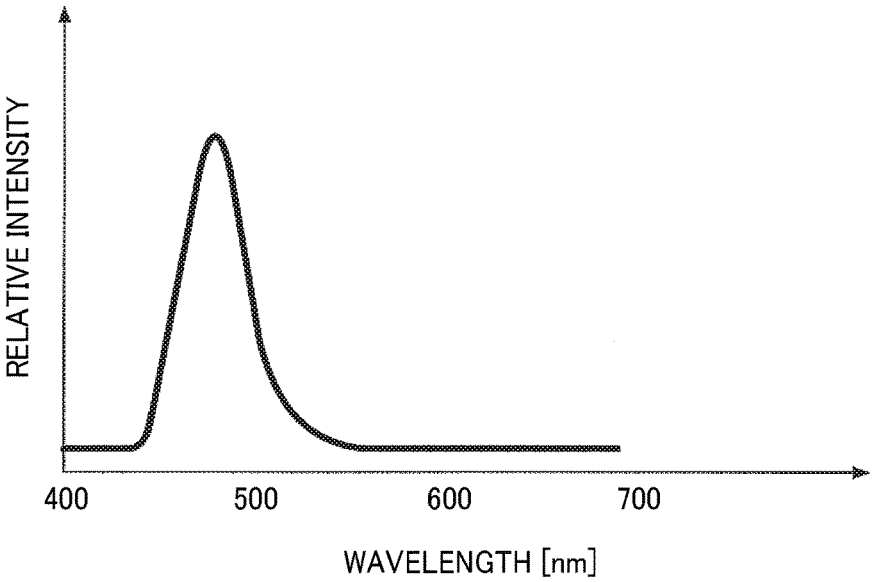
FIG. 10 is a graph of an example spectral property of a blue light source of the sensor device illustrated in FIG. 2.

FIG. 10 is a graph of an example spectral property of the blue light source. In this graph, the lateral axis represents the wavelength, and the vertical axis represents a relative intensity of light emitted from the light source. In this example, the blue light source has a peak of relative intensity at about 480 nanometers. The blue light source irradiates, with relatively intense light, the ink having the property illustrated in FIG. 9. Such a light source is used for the cyan light sources LGC.

With the above-described combination of the liquid and the light source LG, light is reflected well on the liquid. Although the light source used in the example described above has a high relative intensity in the wavelength range in which the relative reflectance of the ink is close to the peak, the light source is not limited thereto. For example, when a range in which the relative reflectance of the ink is lowest is 0% and a range in which the relative reflectance of the ink is highest is 100% in the visible spectrum, any light source having a relative intensity in the range in which the reflectance is 30% or higher can be used. The light source preferably has a high relative intensity in the range in which the reflectance is 50% or higher and, more preferably, has a high relative intensity in the range in which the reflectance is 80% or higher.

Note that, in another embodiment, the fifth sensor device SN5 is omitted. For example, based on the calculation results of the detection by the third and fourth sensor devices SN3 and SN4, the position and the speed relating to the liquid discharge head unit 210K are predicted. Alternatively, the fourth sensor device SN4 performs sensing twice to also serve as the fifth sensor device SN5.

Further, the term "location of sensor" means the position where the detection is performed. Accordingly, it is not necessary that all components relating to the detection are disposed at the "location of sensor (e.g., the optical sensor OS)". In one embodiment, some of the components are coupled to the optical sensor OS via a cable and disposed away therefrom.

In the description below, the sensor devices SN1, SN2, SN3, SN4, and SN5 may be collectively referred to as "sensor devices SN". Similarly, the optical sensors OS1, OS2, OS3, OS4, and OS5 may be collectively referred to as "optical sensors OS", and the light sources LGY1, LGY2, LGM1, LGM2, LGC1, LGC2, LGIR1, and LGIR2 may be collectively referred to as "light sources LG".

Although the sensor devices SN are disposed facing the front side of the web 120 (to emit light to the front side and detect the front side) in FIG. 2, in another embodiment, sensor devices are disposed facing the back side of the web 120.

Figure 11:
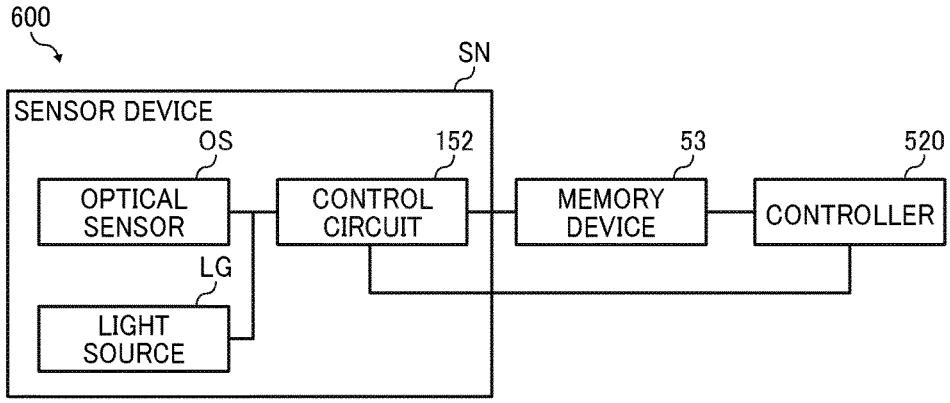
FIG. 11 is a schematic block diagram illustrating a hardware configuration of a conveyed object detector according to an embodiment.

FIG. 11 is a schematic block diagram illustrating a configuration of a conveyed object detector 600 according to an embodiment. For example, the conveyed object detector 600 is implemented by hardware such as the sensor device SN including a control circuit 152, a memory device 53, and the controller 520.

Figure 12:
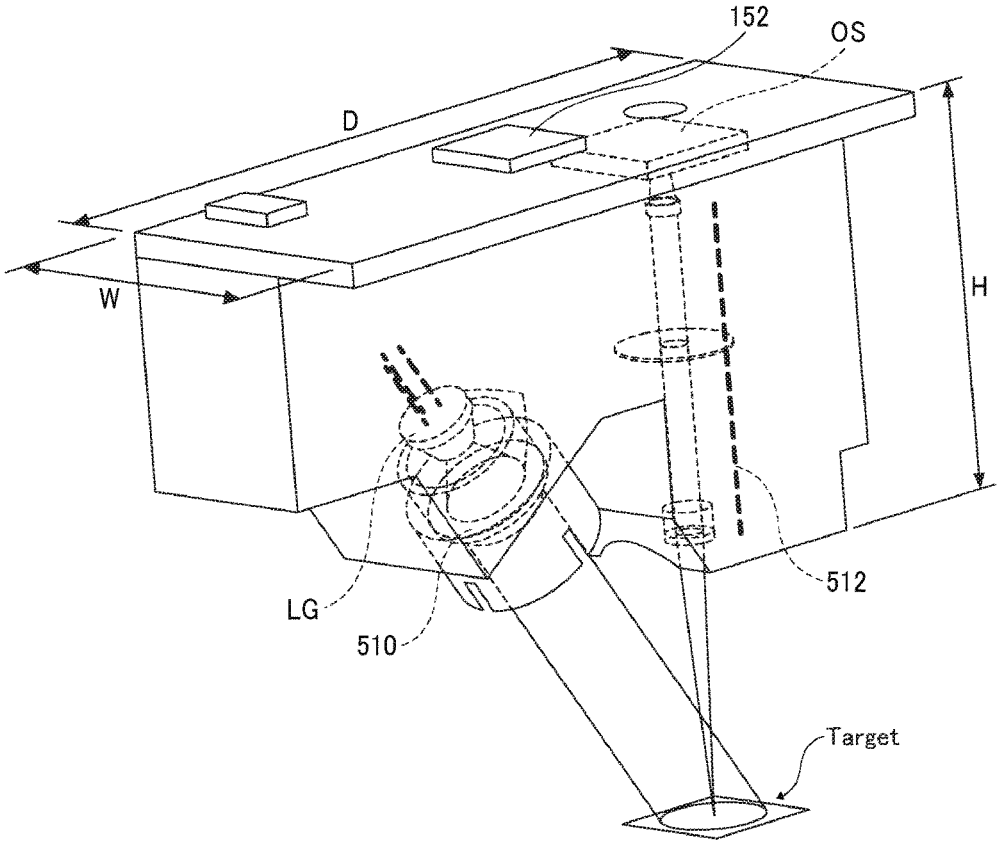
FIG. 12 is an external view of a sensor device according to an embodiment.

FIG. 12 is a perspective view of an example structure of the sensor device SN serving as the detector according to the present embodiment.

The sensor device SN illustrated is configured to capture a speckle pattern, which appears on a conveyed object (i.e., a target in FIG. 12) such as the web 120 when the conveyed object is irradiated with light from the light source. Specifically, the sensor device SN includes the light source LG such as semiconductor laser light source (e.g., a laser diode or LD). Although FIG. 12 illustrates an example structure including a single light source LG, some of the sensors SN include two light sources LG. The sensor device SN further includes an optical system 510 such as collimate optical system. To obtain image data of the pattern on the conveyed object, the sensor device SN further includes a CMOS image sensor, serving as the optical sensor OS, and a telecentric optical system for condensation of light and imaging of the pattern on the CMOS image sensor.

In the illustrated structure, the CMOS image sensor (the optical sensor OS) performs imaging of the pattern to obtain the image data. Then, the conveyed object detector 600 performs correlation operation using the image captured by one CMOS image sensor and the image captured by the CMOS image sensor of another sensor device SN. For example, the controller 520 performs the correlation operation. Based on a displacement of a correlation peak position obtained through the correlation operation, the controller 520 outputs the amount of movement of the conveyed object (e.g., the recording medium) from one sensor device SN to the other sensor device SN. In the illustrated example, the sensor device SN has a width W of 15 mm, a depth D of 60 mm, and a height H of 32 mm (15×60×32). The correlation operation is described in detail later.

Figure 13:
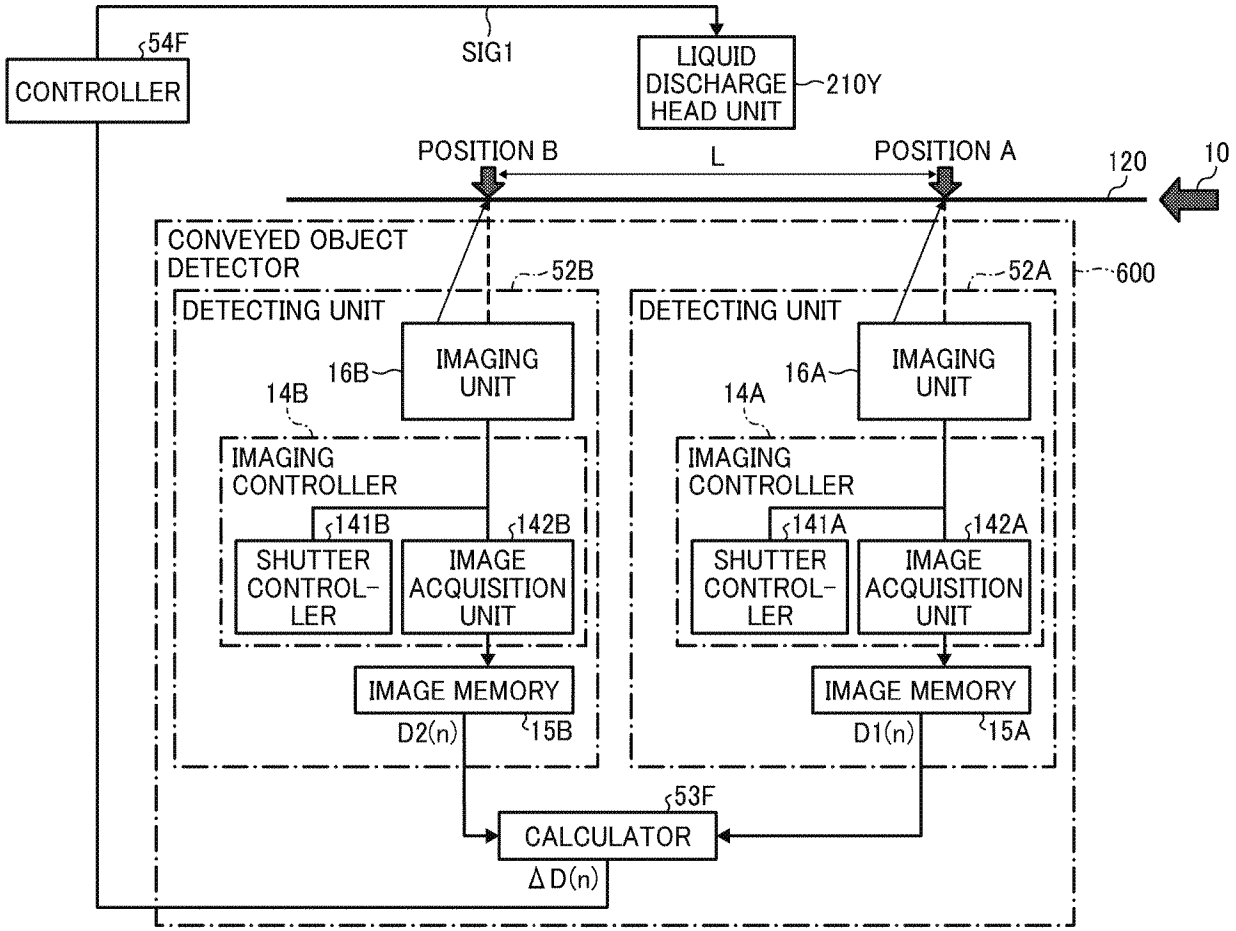
FIG. 13 is a schematic block diagram of a functional configuration of the conveyed object detector illustrated in FIG. 11.

The CMOS image sensor is an example hardware structure to implement an imaging unit 16 (16A or 16B) illustrated in FIG. 13.

Although the controller 520 performs the correlation operation in this example, in one embodiment, the control circuit 152 of one of the sensor devices SN performs the correlation operation. For example, the control circuit 152 is a field-programmable gate array (FPGA) circuit.

Referring back to FIG. 11, the control circuit 152 controls the optical sensor OS and the like. Specifically, the control circuit 152 outputs trigger signals to the optical sensor OS to control the shutter timing of the optical sensor OS. The control circuit 152 causes the optical sensor OS to generate the two-dimensional images and acquires the two-dimensional images therefrom. Then, the control circuit 152 transmits the two-dimensional images generated by the optical sensor OS to the memory device 53. Note that the control circuit 152 can be an external device such as an external FPGA coupled to the sensor device SN.

The memory device 53 is a so-called memory and preferably has a capability to divide the two-dimensional images transmitted from the control circuit 152 or the like and store the divided images in different memory ranges.

For example, the controller 520 is a microcomputer. The controller 520 performs operations using the image data stored in the memory device 53, to implement a variety of processing.

The control circuit 152 and the controller 520 are, for example, central processing units (CPUs) or electronic circuits. Note that a single device can double as the control circuit 152 and the controller 520. The control circuit 152 and the controller 520 are implemented by a single CPU in one embodiment and, alternatively, are implemented by a single FPGA circuit in another embodiment.

FIG. 13 is a schematic block diagram of a functional configuration of the conveyed object detector 600 according to an embodiment. Descriptions below are based on a combination of the sensor devices SN1 and SN2 respectively disposed upstream and downstream from the liquid discharge head unit 210Y (see FIG. 3), of the sensor devices SN. In the illustrated example, a detecting unit 52A, which is a function of the sensor device SN1, outputs a detection result concerning the position A, and a detecting unit 52B, which is a function of the sensor device SN2, outputs a detection result concerning the position B. The detecting units 52A and 52B may be collectively referred to as "detecting units 52". The detecting unit 52A includes, for example, the imaging unit 16A, an imaging controller 14A, and an image memory 15A. In this example, the detecting unit 52B is similar in configuration to the detecting unit 52A. The detecting unit 52B includes the imaging unit 16B, an imaging controller 14B, and an image memory 15B. The detecting unit 52A is described below.

The imaging unit 16A captures an image of the web 120 conveyed in the conveyance direction 10.

The imaging controller 14A includes a shutter controller 141A and an image acquisition unit 142A. The imaging controller 14A is implemented by, for example, the control circuit 152 (illustrated in FIG. 11).

The image acquisition unit 142A captures the image generated by the imaging unit 16A.

The shutter controller 141A controls the timing of imaging by the imaging unit 16A.

The image memory 15A stores the image acquired by the imaging controller 14A. The image memory 15A is implemented by, for example, the memory device 53 (illustrated in FIG. 11).

A calculator 53F can calculate, based on the image data recorded in the image memories 15A and 15B, at least one of a relative position of the web 120 between the sensor devices SEN, the position of the pattern on the web 120, the speed at which the web 120 moves (hereinafter "moving speed"), and the amount of movement of the web 120. Additionally, the calculator 53F outputs, to the shutter controller 141A, data on time difference Δt indicating the timing of shooting (shutter timing). In other words, the calculator 53F instructs the shutter controller 141A of shutter timings of imaging at the position A and imaging at the position 13 with the time difference Δt. The calculator 53F may also control the motor and the like to convey the web 120 at the calculated conveyance speed. The calculator 53F is implemented by, for example, the microcomputer of the controller 520 (illustrated in FIG. 2).

The web 120 has diffusiveness on a surface thereof or in an interior thereof. Accordingly, when the web 120 is irradiated with light (e.g., laser beam), the reflected light is diffused. The diffuse reflection creates a pattern on the web 120. The pattern is made of spots called "speckle" (i.e., a speckle pattern). Accordingly, when an image of the web 120 is taken, image data representing the pattern on the web 120. From the image data, the position of the pattern is known, and the position of a specific portion of the web 120 can be detected. Such a pattern is generated as the light emitted to the web 120 interferes with a rugged shape, caused by a projection and a recess, on the surface or inside of the web 120.

As the web 120 is conveyed, the speckle pattern on the web 120 is conveyed as well. When an identical speckle pattern is detected at different time points, the amount of movement of the speckle pattern in the conveyance direction 10 is obtained. In other words, the calculator 53F obtains the amount of movement of the speckle pattern based on the detection of an identical speckle pattern, thereby obtaining the conveyance amount of the web 120 in the conveyance direction 10. Further, the calculator 53F converts the calculated conveyance amount into a conveyance amount per unit time, thereby obtain the conveyance speed of the web 120 in the conveyance direction 10.

As illustrated, the imaging unit 16A and the imaging unit 16B are spaced apart in the conveyance direction 10. The imaging unit 116A and the imaging unit 16B perform imaging of the web 120 at the respective positions.

The shutter controller 141A causes the imaging unit 116A to capture the image of the web 120 at time intervals of time difference Δt. Then, based on the speckle pattern in the image generated by the imaging, the calculator 53F obtains the conveyance amount of the web 120. Specifically, it is assumed that V represents a conveyance speed (minis) under an ideal condition without displacement, and the imaging units 16A and 16B are located at a relative distance L from each other in the conveyance direction 10. Under such conditions, an interval from the shooting at the position A to the shooting at the position B (the time difference Δt) can be expressed by Formula 1 below.

$$\Delta t = L/V \qquad \text{Formula 1}$$

In Formula 1 above, the relative distance L (mm) between the imaging unit 16A and the imaging unit 16A and is obtained preliminarily (e.g., by measurement).

The calculator 53F performs cross-correlation operation of image data D1(*n*) generated by the detecting unit 52A and image data D2(*n*) generated by the detecting unit 52B. Hereinafter an image generated by the cross-correlation operation is referred to as "correlated image". For example, based on the correlated image, the calculator 53F calculates the displacement amount ΔD(n), which is the amount of displacement from the position detected with the previous frame or by another sensor device.

For example, the cross-correlation operation is expressed by Formula 2 below.

$$D1 \bigstar D2^* = F-1[F[D1] \cdot F[D2]^*] \qquad \text{Formula 2}$$

Note that, the image data D1(*n*) in Formula 2, that is, the data of the image taken at the position A, is referred to as the image data D1. Similarly, the image data D2(*n*) in Formula 2, that is, the data of the image taken at the position B, is referred to as the image data D2. In Formula 2, "[ ]" represents Fourier transform, "F−1[ ]" represents inverse Fourier transform, "*" represents complex conjugate, and "★" represents cross-correlation operation.

As represented in Formula 2, image data representing the correlation image is obtained through cross-correlation operation "D1★D2" performed on the first image data D1 and the second image data D2. Note that, when the first image data D1 and the second image data D2 are two-dimensional image data, the image data representing the correlation image is two-dimensional image data. When the first image data D1 and the second image data D2 are one-dimensional image data, the image data representing the correlation image is one-dimensional image data.

Regarding the correlation image, when a broad luminance profile causes an inconvenience, phase only correlation can be used. For example, phase only correlation is expressed by Formula 3 below.

$$D1 \bigstar D2^* = F-1[P[F[D1]] \cdot P[F[D2]^*]] \qquad \text{Formula 3}$$

In Formula 3, "P[ ]" represent taking only phase out of complex amplitude, and the amplitude is considered to be "1".

Thus, the calculator 53F can obtain the displacement amount ΔD(n) based on the correlation image even when the luminance profile is relatively broad.

The correlation image represents the correlation between the first image data D1 and the second image data D2. Specifically, as the match rate between the first image data D1 and the second image data D2 increases, a luminance causing a sharp peak (so-called correlation peak) is output at a position close to a center of the correlation image. When the first image data D1 matches the second image data D2, the center of the correlation image and the peak position overlap.

Based on the correlation operation, the calculator 53F outputs the displacement in position between the first image data D1 and the second image data D2 obtained at the time difference Δt, the amount of movement, and the speed of movement. For example, the conveyed object detector 600 detects the amount of movement by which the web 120 has moved in the orthogonal direction 20 from the position of the first image data D1 to the position of the second image data D2. Alternatively, the speed of movement can be detected.

In the arrangement illustrated in FIG. 2, the liquid discharge head unit 210Y is interposed between the first sensor device SN1 and the second sensor device SN2. Since the relative positions of the sensor device SN and the liquid discharge head unit 210 in the conveyance direction 10 is known, the calculator 53F can calculate the amount of movement of the liquid discharge head unit 210 based on the result of calculation using the first image data D1 and the second image data D1 Based on the calculation result generated by the calculator 53F, a controller 54F (e.g., a head controller to control the liquid discharge head units 210) controls the actuator AC1 illustrated in FIG. 3, thereby controlling the position at which the liquid discharged from the head unit strikes the conveyed object (liquid landing position).

Further, based on the result of correlation operation, the calculator 53F can obtain the difference of the conveyance movement of the web 120 in the conveyance direction 10 from the relative distance L. That is, the calculator 53F can be used to calculate both of the position in the conveyance direction 10 and the position in the orthogonal direction 20, based on the two-dimensional (2D) images taken by the imaging units 16A and 16B. Sharing the sensor can reduce the cost of detecting positions in both directions. Additionally, the space for the detection can be small since the number of sensors is reduced.

Based on the calculated difference of the conveyance amount of the web 120 from an ideal distance, the calculator 53F calculates the timing of ink discharge from the liquid discharge head unit 210Y. Based on the calculation result, the controller 54F controls ink discharge from the liquid discharge head unit 210Y.

Figure 14:
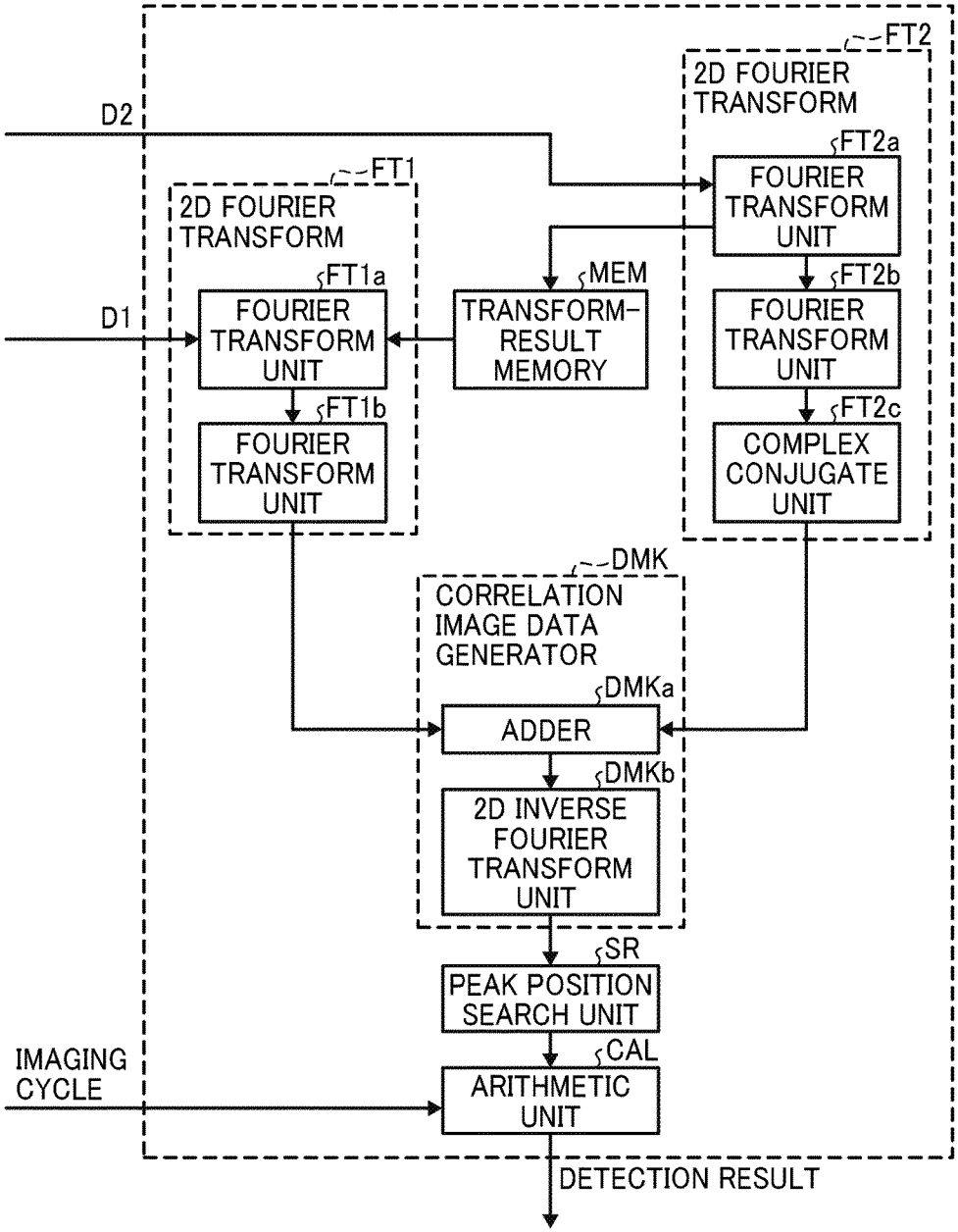
FIG. 14 is a diagram of a method of correlation operation according to an embodiment.

Specifically, the controller 54F outputs a signal SIG1 for the liquid discharge head unit 210Y (a signal SIG2 is for the liquid discharge head unit 210M), to control the timing of ink discharge. The controller 54F is implemented by, for example, the microcomputer of the controller 520 (illustrated in FIG. 2). Example of correlation operation FIG. 14 is a diagram of an example correlation operation performed by the calculator 53F, to output the result of operation including at least one of the relative position of the web 120 at the position of the optical sensor OS, the amount of movement of the web 120, and the speed thereof.

Specifically, the calculator 53F includes a 2D Fourier transform FT1 (a first 2D Fourier transform), a 2D Fourier transform FT2 (second 2D Fourier transform), a correlation image data generator DMK, a peak position search unit SR, an arithmetic unit CAL (or arithmetic logical unit), and a transform-result memory MEM.

The 2D Fourier transform FT1 is configured to transform the first image data D1. The 2D Fourier transform FT1 includes a Fourier transform unit FT1*a* for transform in the orthogonal direction 20 and a Fourier transform unit FT1*b* for transform in the conveyance direction 10.

The Fourier transform unit FT1*a* performs one-dimensional transform of the first image data D1 in the orthogonal direction 20. Based on the result of transform by the Fourier transform unit FT1*a* for orthogonal direction, the Fourier transform unit FT1*b* performs one-dimensional transform of the first image data D1 in the conveyance direction 10. Thus, the Fourier transform unit FT1*a* and the Fourier transform unit FT1*b* perform one-dimensional transform in the orthogonal direction 20 and the conveyance direction 10, respectively. The 2D Fourier transform FT1 outputs the result of transform to the correlation image data generator DMK.

Similarly, the 2D Fourier transform FT2 is configured to transform the second image data D2. The 2D Fourier transform FT2 includes a Fourier transform unit FT2*a* for transform in the orthogonal direction 20, a Fourier transform unit FT2*b* for transform in the conveyance direction 10, and a complex conjugate unit FT2*c*.

The Fourier transform unit FT2*a* performs one-dimensional transform of the second image data D2 in the orthogonal direction 20. Based on the result of transform by the Fourier transform unit FT2*a* for orthogonal direction, the Fourier transform unit FT2*b* performs one-dimensional transform of the second image data D2 in the conveyance direction 10. Thus, the Fourier transform unit FT2*a* and the Fourier transform unit FT2*b* perform one-dimensional transform in the orthogonal direction 20 and the conveyance direction 10, respectively.

Subsequently, the complex conjugate unit FT2*c* calculates a complex conjugate of the results of transform by the Fourier transform unit FT2*a* (for orthogonal direction) and the Fourier transform unit FT2*b* (for conveyance direction). Then, the 2D Fourier transform FT2 outputs, to the correlation image data generator DMK, the complex conjugate calculated by the complex conjugate unit FT2*c*.

The correlation image data generator DMK then generates the correlation image data, based on the transform result of the first image data D1, output from the 2D Fourier transform FT1, and the transform result of the second image data D2, output from the 2D Fourier transform FT2.

The correlation image data generator DMK includes an adder DMKa and a 2D inverse Fourier transform unit DMKb.

The adder DMKa adds the transform result of the first image data D1 to that of the second image data D2 and outputs the result of addition to the 2D inverse Fourier transform unit DMKb.

The 2D inverse Fourier transform unit DMKb performs 2D inverse Fourier transform of the result generated by the adder DMKa. Thus, the correlation image data is generated through 2D inverse Fourier transform. The 2D inverse Fourier transform unit DMKb outputs the correlation image data to the peak position search unit SR.

The peak position search unit SR searches the correlation image data for a peak position (a peak luminance or peak value), at which rising is sharpest. To the correlation image data, values indicating the intensity of light, that is, the degree of luminance, are input. The luminance values are input in matrix.

Note that, in the correlation image data, the luminance values are arranged at a pixel pitch of the optical sensor OS (i.e., an area sensor), that is, pixel size intervals. Accordingly, the peak position is preferably searched for after performing so-called sub-pixel processing. Sub-pixel processing enhances the accuracy in searching for the peak position. Then, the calculator 53F can accurately output the position, the amount of movement, and the speed of movement.

Figure 15:
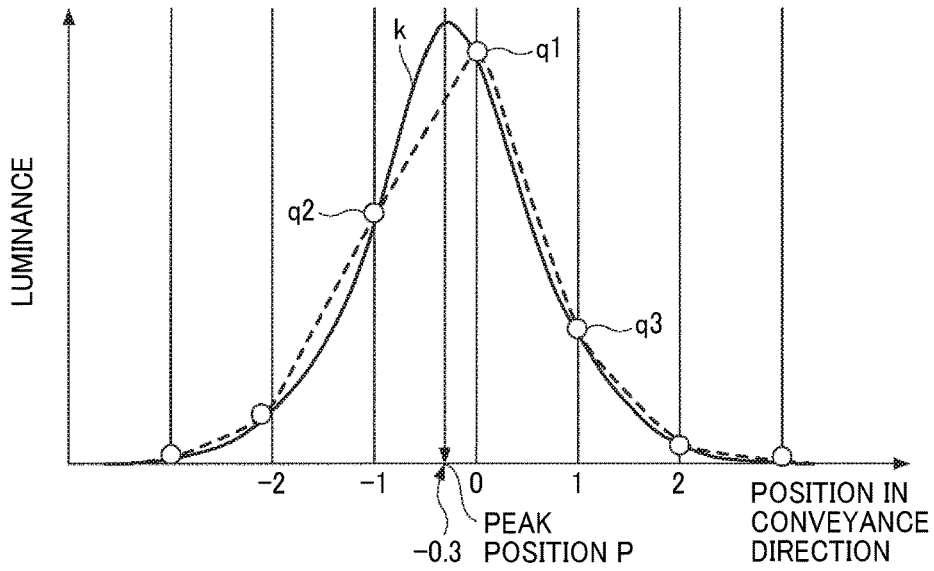
FIG. 15 is a graph for understanding of a peak position searched in the correlation operation illustrated in FIG. 14.

An example of searching by the peak position search unit SR is described below, with reference to the graph illustrated in FIG. 15.

In this graph, the lateral axis represents the position in the conveyance direction 10 of an image represented by the correlation image data, and the vertical axis represents the luminance values of the image represented by the correlation image data.

The luminance values indicated by the correlation image data are described below using a first data value q1, a second data value q2, and a third data value q3. In this example, the peak position search unit SR searches for peak position P on a curved line k connecting the first, second, and third data values q1, q2, and q3.

Initially, the peak position search unit SR calculates each difference between the luminance values indicated by the correlation image data. Then, the peak position search unit SR extracts a largest difference combination, meaning a combination of luminance values between which the difference is largest among the calculated differences. Then, the peak position search unit SR extracts combinations of luminance values adjacent to the largest difference combination. Thus, the peak position search unit SR can extract three data values, such as the first, second, and third data values q1, q2, and q3 in the graph. The peak position search unit SR calculates the curved line K connecting these three data values, thereby obtaining the peak position P. In this manner, the peak position search unit SR can reduce the amount of operation such as sub-pixel processing to increase the speed of searching for the peak position P. The position of the combination of luminance values between which the difference is largest means the position at which rising is sharpest. The manner of sub-pixel processing is not limited to the description above.

Through the searching of the peak position P performed by the peak position search unit SR, for example, the following result is attained.

Figure 16:
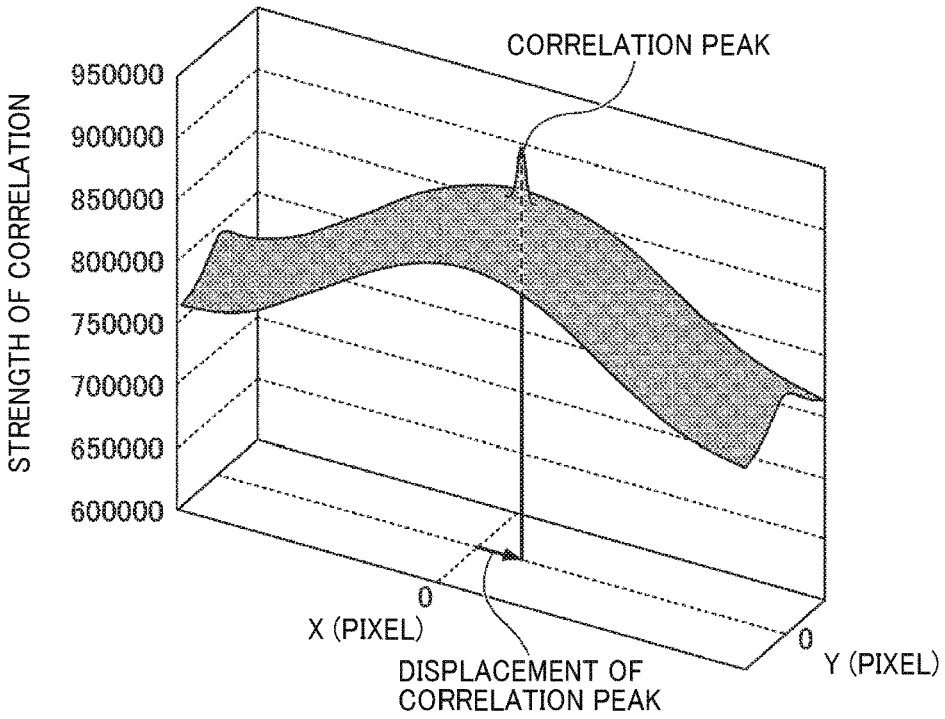
FIG. 16 is a diagram of example results of correlation operation illustrated in FIG. 14.

FIG. 16 is a graph of example results of correlation operation and illustrates a profile of strength of correlation of a correlation function. In FIG. 16, X axis and Y axis represent serial number of pixel. The peak position search unit SR searches for a peak position such as "correlation peak" in the graph.

The arithmetic unit CAL calculates the relative position, amount of movement, or speed of movement of the web 120, or a combination thereof. For example, the arithmetic unit CAL calculates the difference between a center position of the correlation image data and the peak position calculated by the peak position search unit SR, to obtain the relative position and the amount of movement.

For example, the arithmetic unit CAL divides the amount of movement by time, to obtain the speed of movement.

Thus, the calculator 53F can calculate, through the correlation operation, the relative position, amount of movement, or speed of movement of the web 120. The methods of calculation of the relative position, the amount of movement, and the speed of movement are not limited to those described above. For example, alternatively, the calculator 53F obtains the relative position, amount of movement, or speed of movement through the following method.

Initially, the calculator 53F binarizes each luminance value of the first image data D1 and the second image data D2. That is, the calculator 53F binarizes a luminance value not greater than a predetermined threshold into "0" and a luminance value grater than the threshold into "1". Then, the calculator 53F may compare the binarized first and second image data D1 and D2 to obtain the relative position.

Although the description above concerns a case where fluctuations are present in Y direction, the peak position occurs at a position displaced in the X direction when there are fluctuations in the X direction.

Alternatively, the calculator 53F can adapt a different method to obtain the relative position, amount of movement, or speed of movement. For example, the calculator 53F can adapt so-called pattern matching processing to detect the relative position based on a pattern taken in the image data.

Figure 17A:
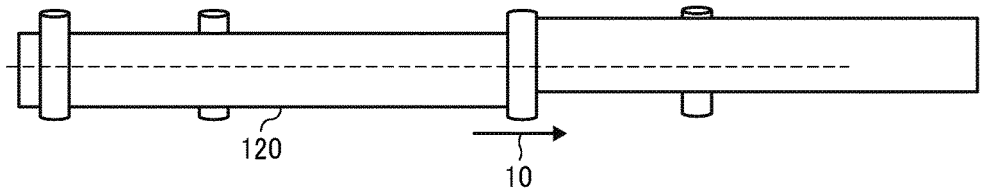
FIGS. 17A and 17B are plan view of a recording medium being conveyed.
Figure 17B:
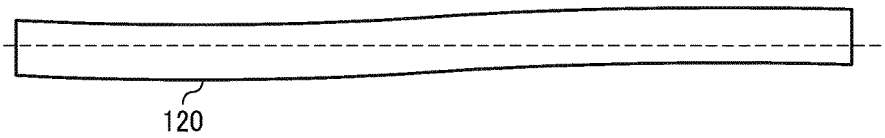
Figure 18:
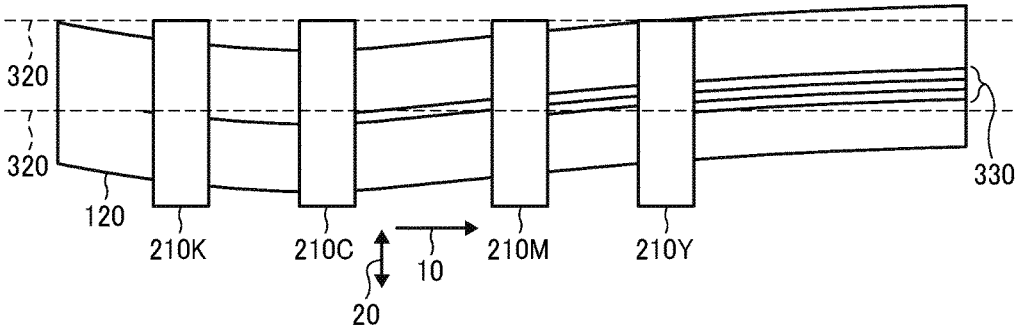
FIG. 18 is a plan view of the recording medium being conveyed and illustrates creation of an image out of color registration.

Descriptions are given below of displacement of the recording medium in the orthogonal direction 20, with reference to FIGS. 17A and 17B, which are plan view of the web 120 being conveyed. In FIG. 17A, the web 120 is conveyed in the conveyance direction 10 by the rollers (such as the roller 230 in FIG. 3). While being conveyed, the position of the web 120 may fluctuate in the orthogonal direction 20 as illustrated in FIG. 17B. That is, the web 120 may meander as illustrated in FIG. 17B.

The fluctuation of the position of the web 120 in the orthogonal direction 20 (hereinafter "orthogonal position of the web 120"), that is, the meandering of the web 120, is caused by eccentricity of a conveyance roller (the driving roller in particular), misalignment, or tearing of the web 120 by a blade. When the web 120 is relatively narrow in the orthogonal direction 20, for example, thermal expansion of the roller affect fluctuation of the web 120 in the orthogonal position.

Descriptions are given below of the occurrence of misalignment in color superimposition (images out of color registration). Due to fluctuations (meandering illustrated in FIG. 17B) of the web 120 (the recording medium) in the orthogonal position, images become out of color registration as illustrated in FIG. 14.

Specifically, to form a multicolor image on a recording medium using a plurality of colors, the image forming apparatus 110 superimposes a plurality of different color inks discharged from the liquid discharge head units 210, through so-called color plane, on the web 120.

As illustrated in FIG. 17B, the web 120 can fluctuate in position and meanders, for example, with reference to lines 320. Assuming that the liquid discharge head units 210 discharge respective inks to an identical portion (i.e., an intended droplet landing position) on the web 120 in this state, a portion 330 out of color registration is created since the intended droplet landing position fluctuate in the orthogonal direction 20 while the web 120 meanders between the liquid discharge head units 210. The portion 330 out of color registration is creased as the position of a line or the like, drawn by the respective inks discharged from the liquid discharge head units 210, shakes in the orthogonal direction 20. The portion 330 out of color registration degrades the quality of the image on the web 120.

The controller 520 is described below.

Figure 19:
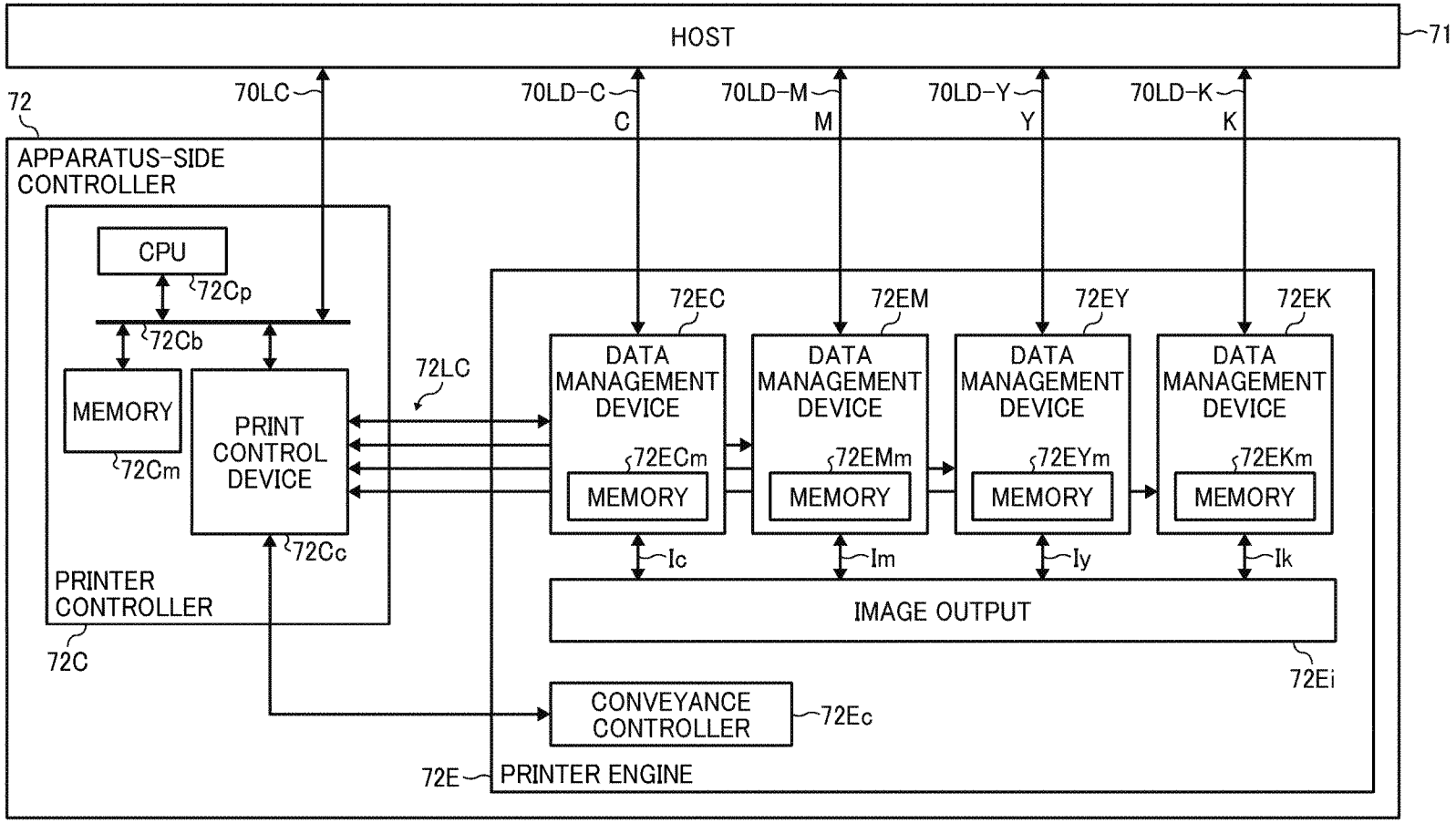
FIG. 19 is a schematic block diagram of control configuration according to an embodiment.

FIG. 19 is a schematic block diagram of control configuration according to the present embodiment. For example, the controller 520 is constructed of a host 71, such as an information processing apparatus, and an apparatus-side controller 72. In the illustrated example, the controller 520 causes the apparatus-side controller 72 to control image formation on a recording medium according to image data and control data input from the host 71.

Examples of the host 71 include a client computer (personal computer or PC) and a server. The apparatus-side controller 72 includes a printer controller 72C and a printer engine 72E.

The printer controller 72C governs operation of the printer engine 72E. The printer controller 72C transmits and receives the control data to and from the host 71 via a control line 70LC. The printer controller 72C further transmits and receives the control data to and from the printer engine 72E via a control line 72LC. Through such data transmission and reception, the control data indicating printing conditions and the like are input to the printer controller 72C. The printer controller 72C stores the printing conditions, for example, in a resistor. The printer controller 72C then controls the printer engine 72E according to the control data to form an image based on print job data, that is, the control data.

The printer controller 72C includes a CPU 72Cp, a print control device 72Cc, and a memory 72Cm. The CPU 72Cp and the print control device 72Cc are connected to each other via a bus 72Cb to communicate with each other. The bus 72Cb is connected to the control line 70LC via a communication interface (I/F) or the like.

The CPU 72Cp controls the entire apparatus-side controller 72 based on a control program and the like. That is, the CPU 72Cp is a processor as well as a controller.

The print control device 72Cc transmits and receives data indicating a command or status to and from the printer engine 72E, based on the control date transmitted from the host 71. Thus, the print control device 72Cc controls the printer engine 72E.

To the printer engine 72E, a plurality of data lines, namely, data lines 70LD-C, 70LD-M, 70LD-Y and 70LD-K are connected. The printer engine 72E receives the image data from the host 71 via the plurality of data lines. Then, the printer engine 72E performs image formation of respective colors, controlled by the printer controller 72C.

The printer engine 72E includes a plurality of data management devices, namely, data management devices 72EC, 72EM, 72EY, and 72EK. The printer engine 72E includes an image output 72Ei and a conveyance controller 72Ec.

Figure 20:
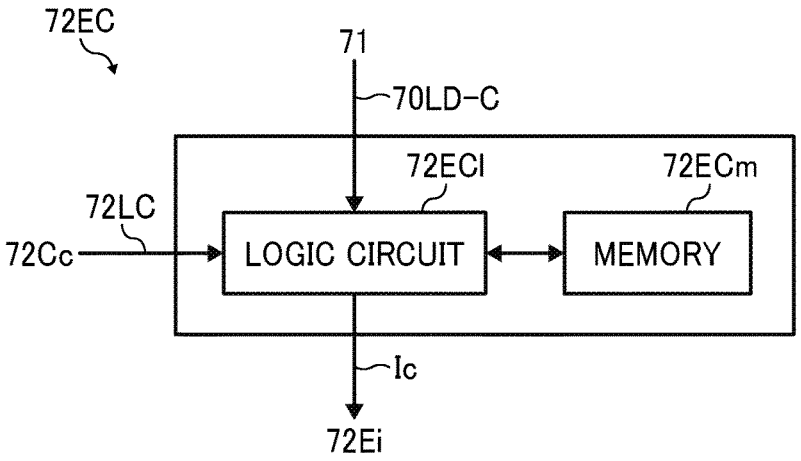
FIG. 20 is a block diagram of a hardware configuration of a data management device illustrated in FIG. 19.

FIG. 20 is a block diagram of a configuration of the data management device 72EC. For example, the data management devices 72EC, 72EM, 72EY, and 72EK are identical in configuration, and the data management device 72EC is described below as a representative. Redundant descriptions are omitted.

The data management device 72EC includes a logic circuit 72ECl and a memory 72ECm. As illustrated in FIG. 20, the logic circuit 72ECl is connected via a data line 70LD-C to the host 71. The logic circuit 72ECl is connected via the control line 72LC to the print control device 72Cc. The logic circuit 72ECl is implemented by, for example, an application specific integrated circuit (ASIC) or a programmable logic device (PLD).

According to a control signal input from the printer controller 72C (illustrated in FIG. 19), the logic circuit 72ECl stores, in the memory 72ECm, the image data input from the host 71.

According to a control signal input from the printer controller 72C, the logic circuit 72ECl retrieves, from the memory 72ECm, cyan image data Ic. The logic circuit 72ECl then transmits the cyan image data Ic to the image output 72Ei.

The memory 72ECm preferably has a capacity to store image data extending about three pages. With the capacity to store image data extending about three pages, the memory 72ECm can store the image data input from the host 71, data image being used current image formation, and image data for subsequent image formation.

Figure 21:
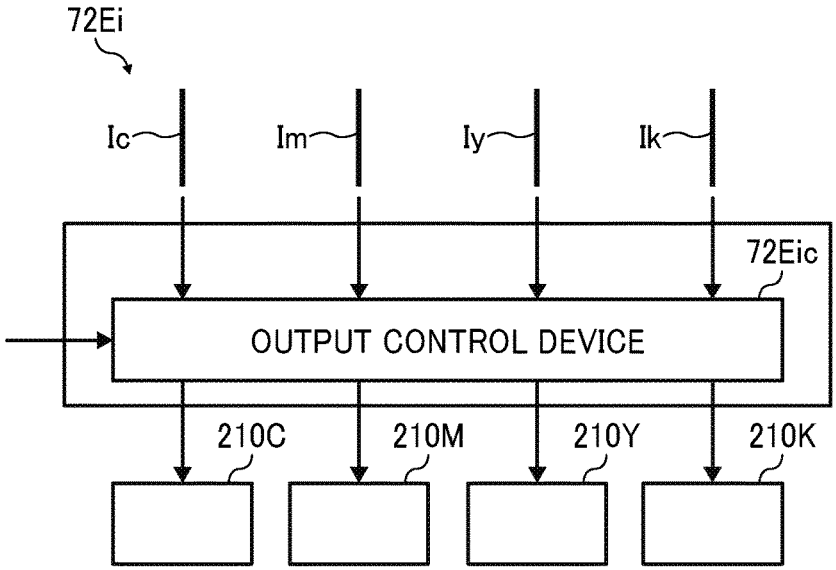
FIG. 21 is a block diagram of a hardware configuration of an image output device illustrated in FIG. 19.

FIG. 21 is a block diagram of a configuration of the image output 72Ei. In this black diagram, the image output 72Ei is constructed of an output control device 72Eic and the liquid discharge head units 210K, 210C, 210M, and 210Y.

The output control device 72Eic outputs the image data for respective colors to the liquid discharge head units 210. That is, the output control device 72Eic controls the liquid discharge head units 210 based on the image data input thereto.

The output control device 72Eic controls the plurality of liquid discharge head units 210 either simultaneously or individually. That is, the output control device 72Eic receives timing commands and changes the timings at which the liquid discharge head units 210 discharge respective color inks. The output control device 72Eic may control one or more of the liquid discharge head units 210 based on the control signal input from the printer controller 72C (illustrated in FIG. 19). Alternatively, the output control device 72Eic may control one or more of the liquid discharge head units 210 based on user instructions.

In the apparatus-side controller 72 illustrated in FIG. 19, a route for inputting the image data from the host 71 is different from a route for transmission and reception of control data, with the host 71 and the apparatus-side controller 72.

The conveyance controller 72Ec (in FIG. 19) includes a motor, a mechanism, and a driver for conveying the web 120. For example, the conveyance controller 72Ec controls the motor coupled to the rollers to convey the web 120.

Figure 22:
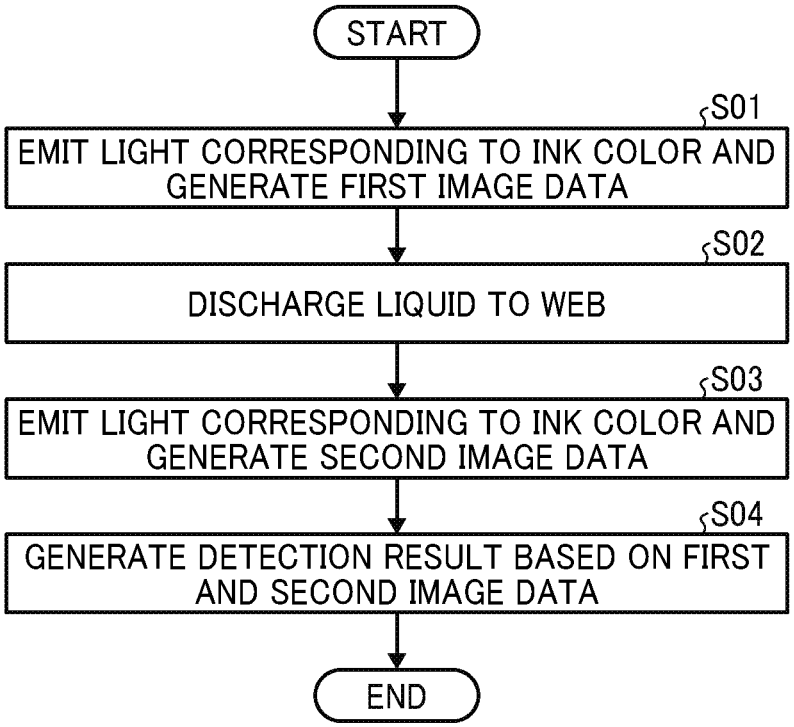
FIG. 22 is a flowchart of processing performed by the liquid discharge apparatus illustrated in FIG. 3.

FIG. 22 is a flowchart of processing performed by the conveyed object detector 600 according to the present embodiment. The processing illustrated in FIG. 22 is performed for each of the liquid discharge head units 210, and the description is made using the liquid discharge head unit 210Y for yellow as a representative.

At S01, the image forming apparatus 110 irradiates the web 120 with light of wavelength corresponding to the color of ink. In this example, the first optical sensor OS1 disposed upstream from the liquid discharge head unit 210Y generates the first image data D1. At S01, in a state in which the web 120 is irradiated with the yellow light emitted from the yellow light source LGY1, the first optical sensor OS1 generates the first image data D1 through imaging of the irradiated web 120.

At S02, the liquid discharge head unit 210Y discharges yellow ink to the web 120.

At S03, the conveyed object detector 600 obtains the second image data D2 while irradiating the web 120 with light of wavelength corresponding to the color of ink discharged at S02. In this example, the second optical sensor OS2 disposed downstream from the liquid discharge head unit 210Y generates the second image data D2 through the imaging. As S03, the yellow light source LGY2 emits light to the web 120. Then, the second optical sensor OS2 generates the second image data D2 through imaging in the state in which the web 120 is irradiated with the light from the yellow light source LGY.

At S04, the calculator 53F calculates at least one of the position and speed of the web 120 based on the first and second image data D1 and D2. Specifically, at S04, the calculator 53F compares the image data captured upstream from the liquid discharge head unit 210Y with the image data captured downstream from the liquid discharge head unit 210Y, to calculate the displacement in the orthogonal direction 20 and the movement amount of the web 120 in the conveyance direction 10.

Thus, the conveyed object detector 600 can calculate the movement amount and the speed of the web 120 based on the image data.

In another embodiment, regarding the light source located upstream from extreme upstream one of at least one liquid discharge head units in the conveyance direction 10, the color of light emitted is not limited. That is, it is not necessary to limit the color of the light applied to a portion without the liquid applied to the conveyed object.

In this case, the conveyed object detector 600 includes a first light source (e.g., LGY1) and a second light source (e.g., LGY2) respectively disposed, in a conveyance direction 10 of the conveyed object, upstream and downstream from a movable liquid discharge head to discharge liquid onto the conveyed object, to irradiate a conveyed object, and a detector including a first optical sensor to generate first image data of an irradiated portion irradiated by the first light source and a second optical sensor to generate second image data of an irradiated portion irradiated by the second light source. The second light source irradiates the conveyed object with light having a high relative intensity in a wavelength range in which relative reflectance of the liquid (discharged from the liquid discharge head) is high. The detector is to generate a detection result based on the first image data and the second image data, and the detection result includes at least one of a conveyance amount of the conveyed object and conveyance speed of the conveyed object.

Descriptions are given below of an example of combinations of the first and second image data for the liquid discharge head units 210.

Figure 23:
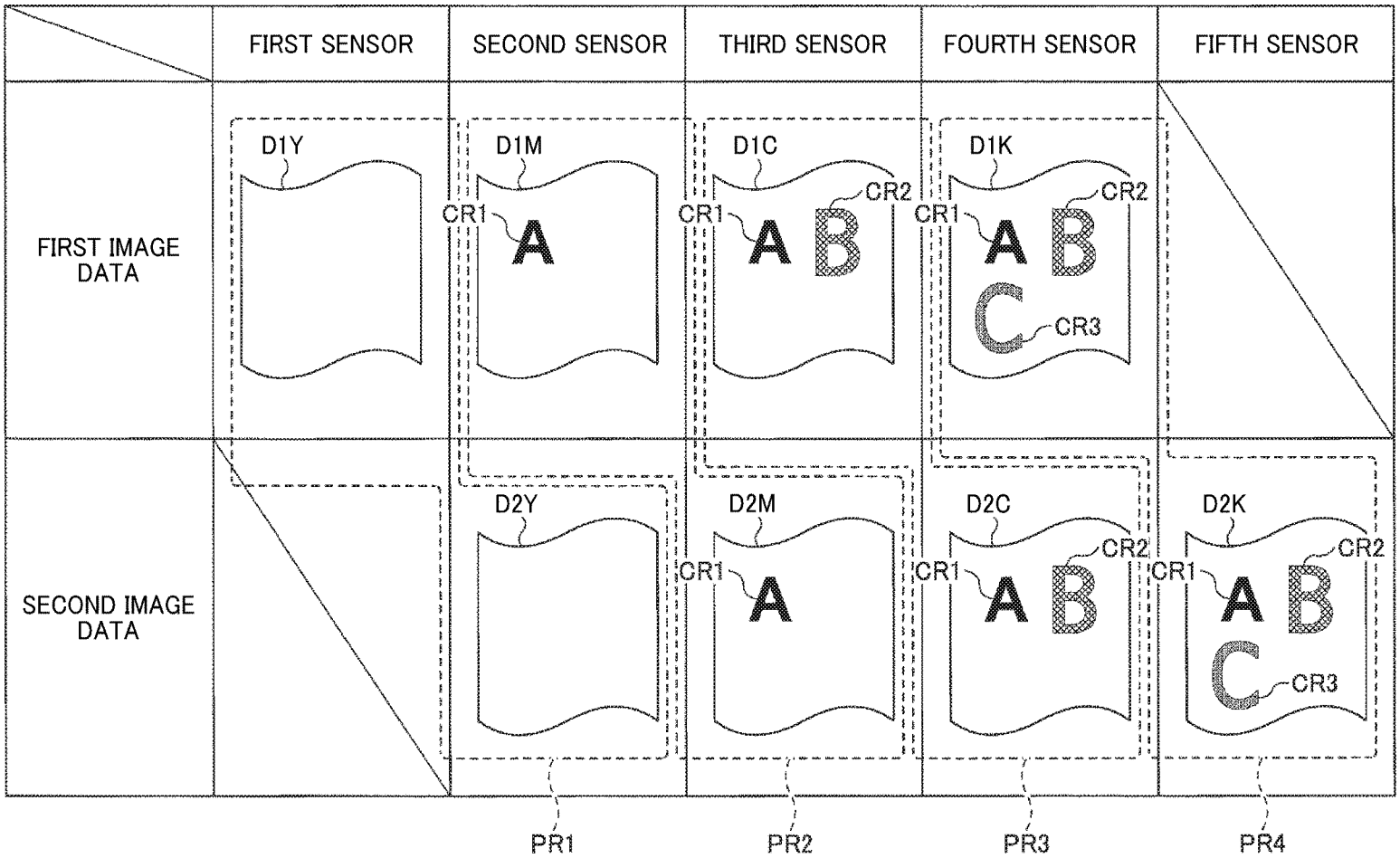
FIG. 23 is a schematic diagram of example combinations of first image data and second image data according to an embodiment.

FIG. 23 is a schematic diagram of example combinations of the first image data D1 and the second image data D2 obtained by the conveyed object detector 600 according to an embodiment. In FIG. 23, "first sensor" to "fifth sensor" represents on the top line represents the first to fifth sensor devices SN1 to SN5, and the first image data generated by the sensor device SN upstream from the liquid discharge head unit 210 is on the next line. The second image data generated by the sensor device SN downstream from the liquid discharge head unit 210 is on the bottom line.

In this example, a first pair PR1 (image data pair) used for the calculation for the liquid discharge head unit 210Y includes first image data D1Y and second image data D2Y, both of which are obtained with irradiation of yellow light. The first image data D1Y is obtained before the yellow ink is discharged. The second image data D2Y is obtained after the yellow ink is discharged. The yellow ink easily reflects the yellow light and easily absorbs light other than yellow light. Accordingly, even when a first letter CR1 ("A" in FIG. 23) formed with the yellow ink enters the sensor detection area irradiated with the yellow light, the yellow light is easily reflected on the first letter CR1. Accordingly, adverse effects caused by the first letter CR1 in yellow are suppressed in detection by the sensor device SN.

In this example, a second pair PR2 used for the calculation for the liquid discharge head unit 210M includes first image data D1M and second image data D2M, both of which are obtained with irradiation of magenta light (e.g., the red light illustrated in FIG. 8). The first image data D1M is obtained after the yellow ink is discharged and before the magenta ink is discharged. The second image data D2M is obtained after the magenta ink is discharged. The magenta ink easily reflects the magenta light and easily absorbs light other than magenta light. Accordingly, even when a second letter CR2 ("B" in FIG. 23) formed with the magenta ink enters the sensor detection area irradiated with the magenta light, the magenta light is easily reflected on the second letter CR2. Accordingly, adverse effects caused by the second letter CR2 in magenta are suppressed in detection by the sensor device SN.

In this example, a third pair PR3 used for the calculation for the liquid discharge head unit 210C includes first image data D1C and second image data D2C, both of which are obtained with irradiation of cyan light (e.g., the blue light illustrated in FIG. 10). The first image data D1C is obtained after the magenta ink is discharged and before the cyan ink is discharged. The second image data D2M is obtained after the cyan ink is discharged. The cyan ink easily reflects the cyan light and easily absorbs light other than cyan light. Accordingly, even when a third letter CR3 ("C" in FIG. 23) formed with the cyan ink enters the sensor detection area irradiated with the cyan light, the cyan light is easily reflected on the third letter CR3. Accordingly, adverse effects caused by the third letter CR3 in cyan are suppressed in detection by the sensor device SN.

In this example, a fourth pair PR4 used for the calculation for the liquid discharge head unit 210K includes first image data D1K and second image data D2K, both of which are obtained with irradiation of infrared light. The first image data D1 is obtained, with irradiation with infrared light, after the cyan ink is discharged and before the black ink is discharged. The second image data D2K is obtained, with irradiation with infrared light, after the black ink is discharged. The black ink absorbs most visible light (wavelengths in the visible spectrum). Accordingly, even when a letter or a pattern formed with the black ink enters the sensor detection area irradiated with the infrared light, the infrared light is easily reflected on the black ink. Accordingly, adverse effects caused by the black ink are suppressed in detection by the sensor device SN.

As illustrated in FIG. 3, when one optical sensor OS generates a plurality of image data, the number of optical sensors can be reduced and the cost can be reduced.

Functional Configuration

Figure 24:
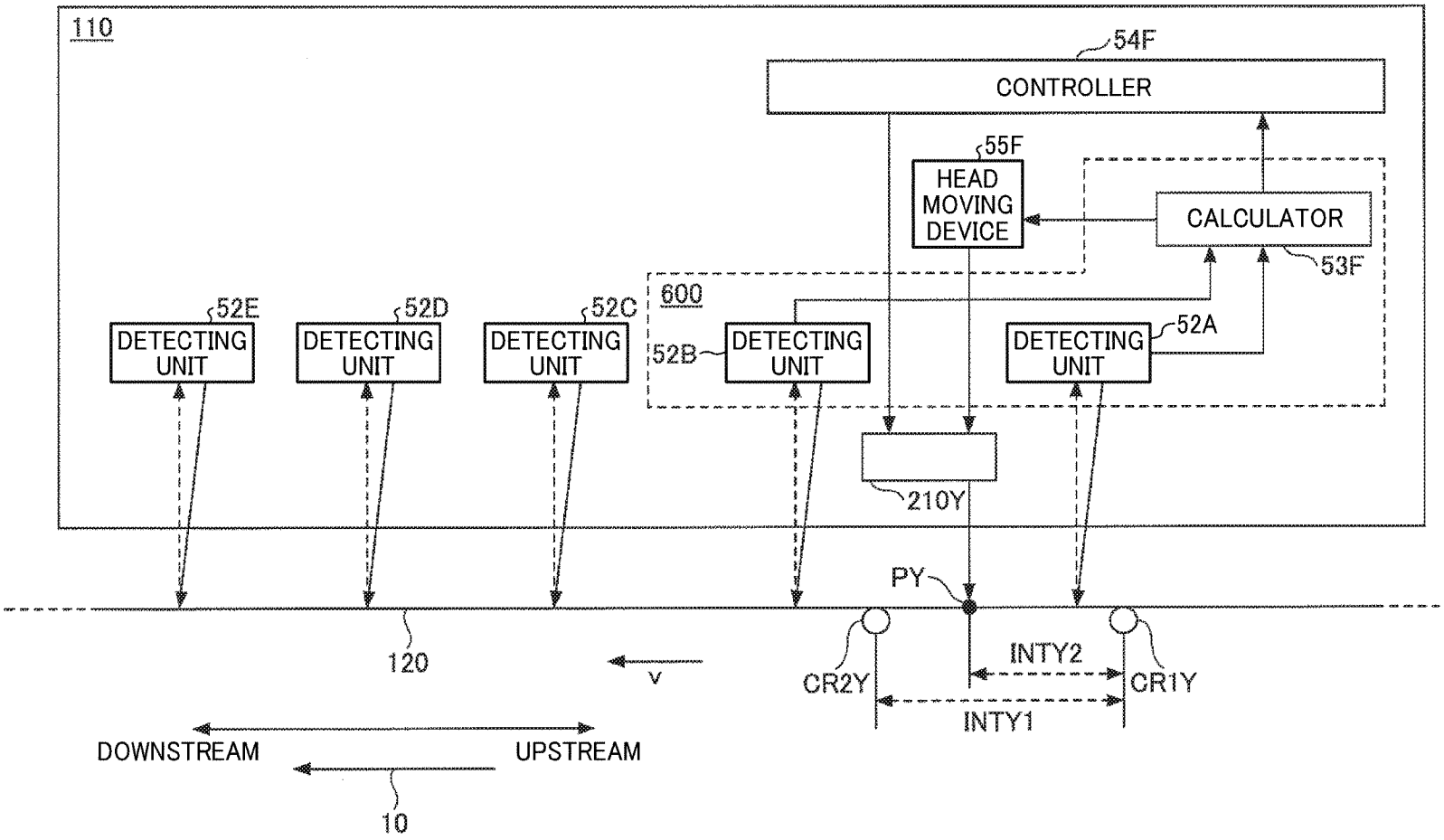
FIG. 24 is a schematic block diagram of a functional configuration of the conveyed object detector according to an embodiment.

FIG. 24 is a schematic block diagram of a functional configuration of the conveyed object detector 600 of the liquid discharge apparatus according to the present embodiment. As illustrated, the image forming apparatus 110 includes a plurality of detecting units 52 (52A, 52B, 52C, 52D, and 52E) and at least one calculator 53F.

In the arrangement illustrated in FIG. 3, there are five detecting units 52. Based on the output from the detecting units 52, the calculator 53F detects the position or the like of the web 120 (the recording medium) in at least one of the conveyance direction 10 or the orthogonal direction 20.

The detecting unit 52 detects the surface of the web 120 being irradiated by the light source LG illustrated in FIG. 3, with the light corresponding to the liquid discharged from the liquid discharge head unit 210. Specifically, the detecting unit 52 detects the surface of the web 120 being irradiated with light having a high relative intensity in a wavelength range in which relative reflectance of the liquid is high.

Note that the image forming apparatus 110 can further include the controller 54F. Based on the calculation by the calculator 53F, the controller 54F controls the timing of ink discharge to the web 120 and the position of the liquid discharge head unit 210 in the orthogonal direction 20. Regarding the liquid discharge head units 210M, 210C, and 210K as well, based on the detection made on the upstream side and that on the downstream side of the liquid discharge head unit 210, the calculator 53F calculates the position or the like of the web 120 in at least one of the orthogonal direction 20 and the conveyance direction 10. Further, the controller 54F controls the timing of ink discharge to the web 120 or the position of the liquid discharge head unit 210 in the orthogonal direction 20.

[Variation 1]

The optical sensor OS and the light source LG can have the following structures.

Figure 25:
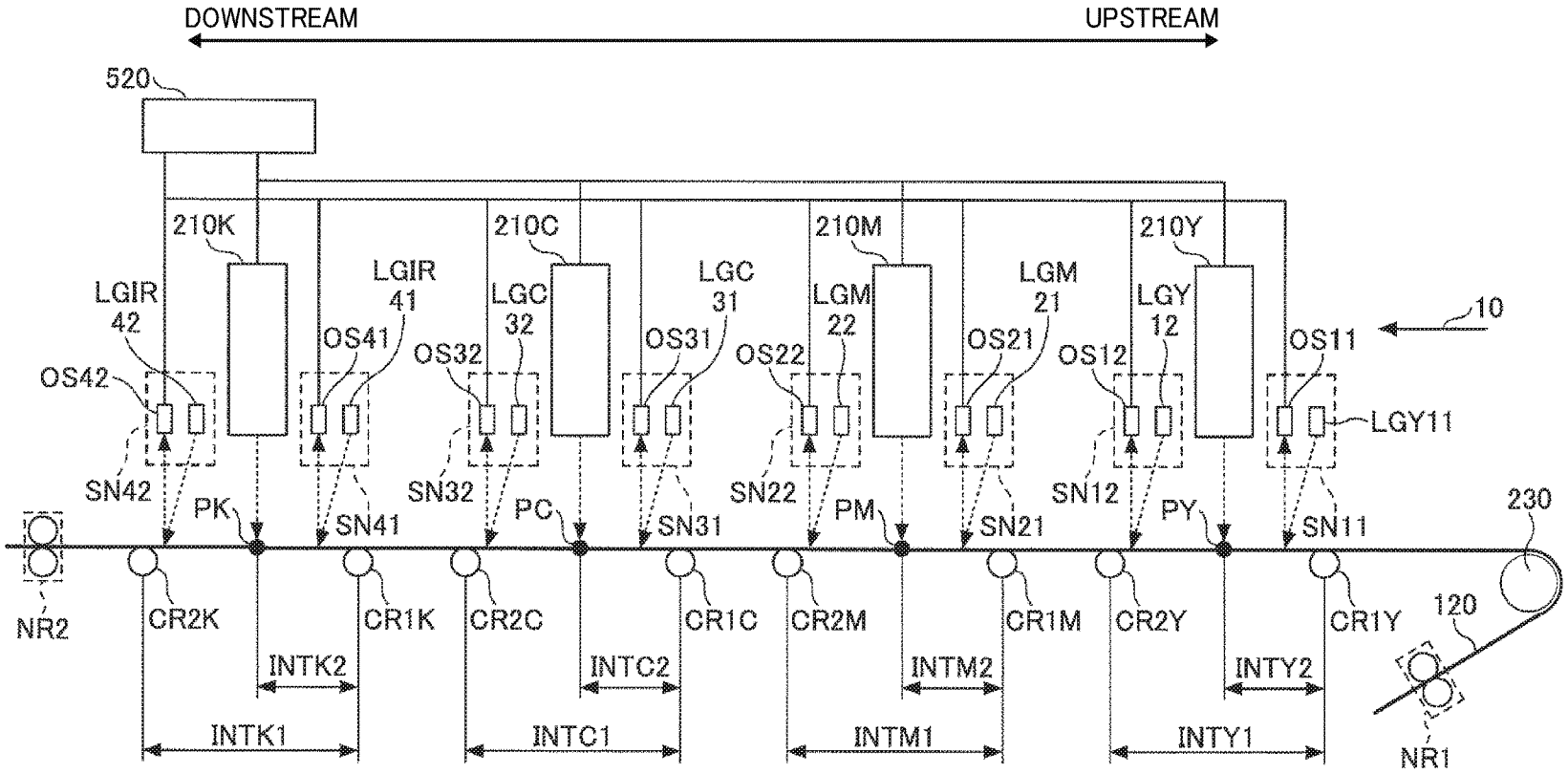
FIG. 25 is a schematic view illustrating a general structure of a liquid discharge apparatus according to Variation 1.

FIG. 25 is a schematic view illustrating a general structure of the liquid discharge apparatus according to Variation 1.

Each liquid discharge head unit 210 is provided with a plurality of rollers. As illustrated in the drawings, for example, the image forming apparatus 110 includes the rollers respectively disposed upstream and downstream from each liquid discharge head unit 210. In the illustrated example, the roller disposed upstream from the liquid discharge head unit 210 is referred to as a first roller to convey the web 120 to the ink discharge position. Similarly, the roller disposed downstream from each liquid discharge head unit 210 is referred to as a second roller to convey the web 120 from the ink discharge position. Disposing the first roller and the second roller for each ink discharge position can suppress fluttering of the recording medium conveyed. For example, the first roller and the second roller are disposed along the conveyance passage of the recording medium and, for example, are driven rollers. Alternatively, the first roller and the second roller may be a driving roller driven by a motor or the like.

Note that, instead of the first and second rollers that are rotators such as driven rollers, first and second supports to support the conveyed object may be used. For example, each of the first and second supports can be a pipe or a shaft having a round cross section. Alternatively, each of the first and second supports can be a curved plate having an arc-shaped face to contact the conveyed object. In the description below, the first and second supporters are rollers.

Specifically, a first roller CR1Y and a second roller CR2Y (first and second supports to support the recording medium) are disposed upstream and downstream from the yellow ink discharge position PY, respectively, in the conveyance direction 10 of the web 120.

Similarly, a first roller CR1M and a second roller CR2M are disposed upstream and downstream from the liquid discharge head unit 210M, respectively. Similarly, a first roller CR1C and a second roller CR2C are disposed upstream and downstream from the liquid discharge head unit 210C for cyan, respectively. Similarly, a first roller CR1K and a second roller CR2K are disposed upstream and downstream from the liquid discharge head unit 210K, respectively.

As illustrated, the location of sensor is preferably close to the first roller CR1. That is, the distance between the ink discharge position and the location of sensor is preferably short. When the distance between the ink discharge position and the optical sensor OS is short, detection error can be suppressed. Accordingly, the position of the recording medium in the conveyance direction 10 and the orthogonal direction 20 can be detected with a sensor accurately.

Specifically, the sensor device SN is disposed between the first roller CR1 and the second roller CR2. That is, in this example, a first upstream sensor device SN11 and a first downstream sensor device SN12 for yellow are disposed in the inter-roller range INTY1 for yellow. The sensor device SN11 includes an optical sensor OS11 and a light source LGY11. The sensor device SN12 includes an optical sensor OS12 and a light source LGY12. Similarly, a second upstream sensor device SN21 and a second downstream sensor device SN22 for magenta are preferably disposed in an inter-roller range INTM1 between the first and second rollers CR1M and CR2M. The sensor device SN21 includes an optical sensor OS21 and a light source LGM21. The sensor device SN22 includes an optical sensor OS22 and a light source LGM22. Similarly, a third upstream sensor device SN31 and a third downstream sensor device SN32 for cyan are preferably disposed in an inter-roller range INTC1 between the first and second rollers CR1C and CR2C. The sensor device SN31 includes an optical sensor OS31 and a light source LGC31. The sensor device SN32 includes an optical sensor OS32 and a light source LGC32. Similarly, a fourth upstream sensor device SN41 and a fourth downstream sensor device SN42 for black are preferably disposed in an inter-roller range INTK1 between the first and second rollers CR1K and CR2K. The sensor device SN41 includes an optical sensor OS41 and a light source LGIR41. The sensor device SN42 includes an optical sensor OS42 and a light source LGIR42.

The optical sensor OS disposed between the first and second rollers CR1 and CR2 can detect the recording medium at a position close to the ink discharge position. The conveyance speed V is relatively stable in a portion between the rollers. Accordingly, the position of the recording medium in the conveyance direction 10 and the orthogonal direction 20 can be detected with a high accuracy.

In this structure, the first upstream sensor device SN11 and the first downstream sensor device SN12 generate the first pair PR1 (the first and second image data D1Y and D2Y) illustrated in FIG. 23. The second upstream sensor device SN21 and the second downstream sensor device SN22 generate the second pair PR2 (the first and second image data D1M and D2M) illustrated in FIG. 23. The third upstream sensor device SN31 and the third downstream sensor device SN32 generate the third pair PR3 (the first and second image data D1C and D2C) illustrated in FIG. 23. The fourth upstream sensor device SN41 and the fourth downstream sensor device SN42 generate the fourth pair PR4 (the first and second image data D1K and D2K) illustrated in FIG. 23.

[Variation 2]

Figure 26:
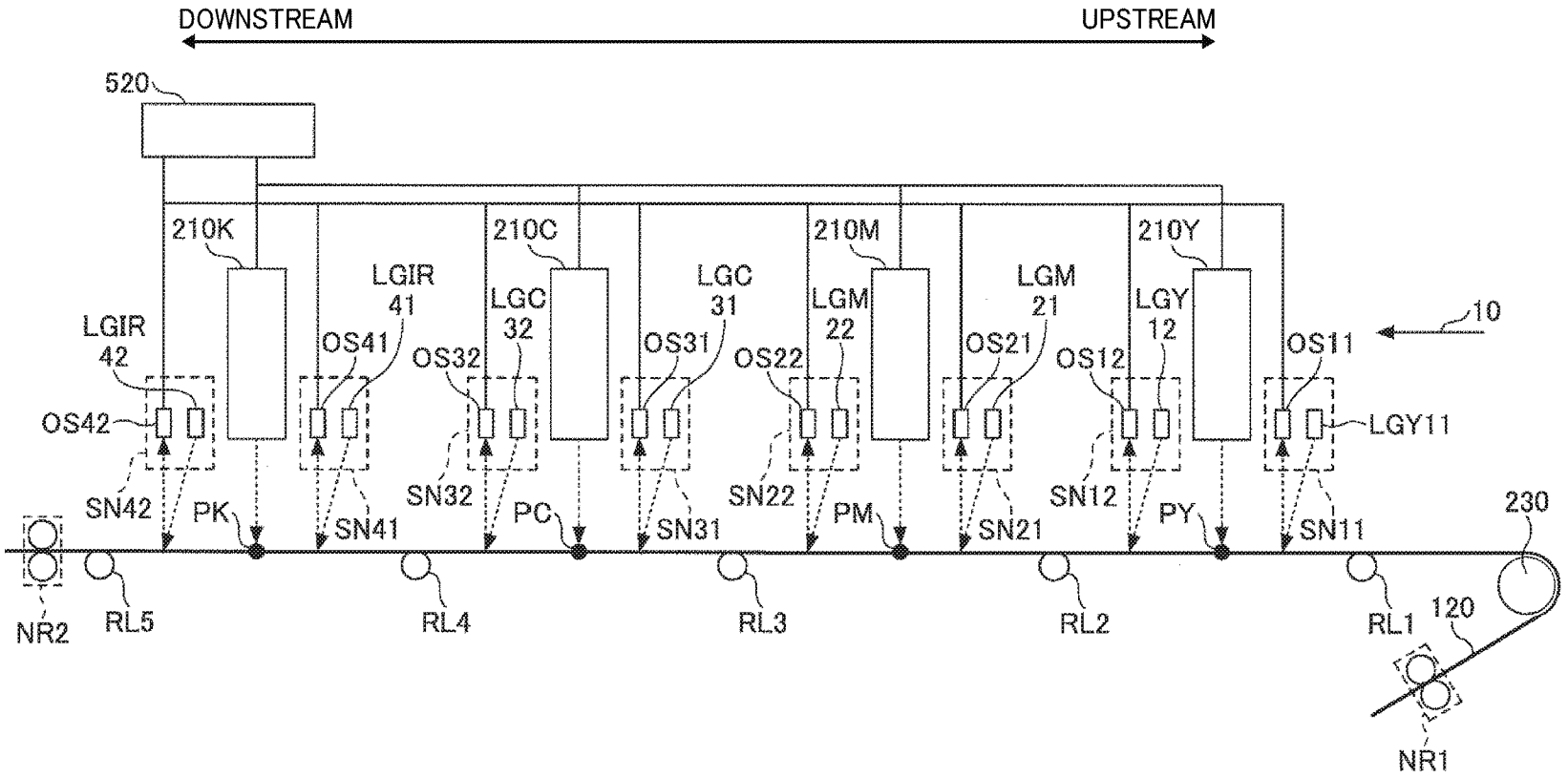
FIG. 26 is a schematic view illustrating a general structure of a liquid discharge apparatus according to Variation 2.

FIG. 26 is a schematic view illustrating a general structure of the liquid discharge apparatus according to Variation 2. This configuration differs from the configuration illustrated in FIG. 25 regarding the locations of the first support and the second support. The image forming apparatus 110 illustrated in FIG. 14 includes supports RL1, RL2, RL3, RL4, and RL5, serving as the first and second supports. In other words, the second support (e.g., the conveyance roller CR2K in FIG. 2) disposed downstream from the upstream one of adjacent two head units also serves as the first support (e.g., the conveyance roller CR1C in FIG. 2) disposed upstream from the downstream one of the adjacent two head units. Note that, the support according to the variation, which doubles as the first and second supports, can be either a roller or a curved plate.

[Variation 3]

Figure 27:
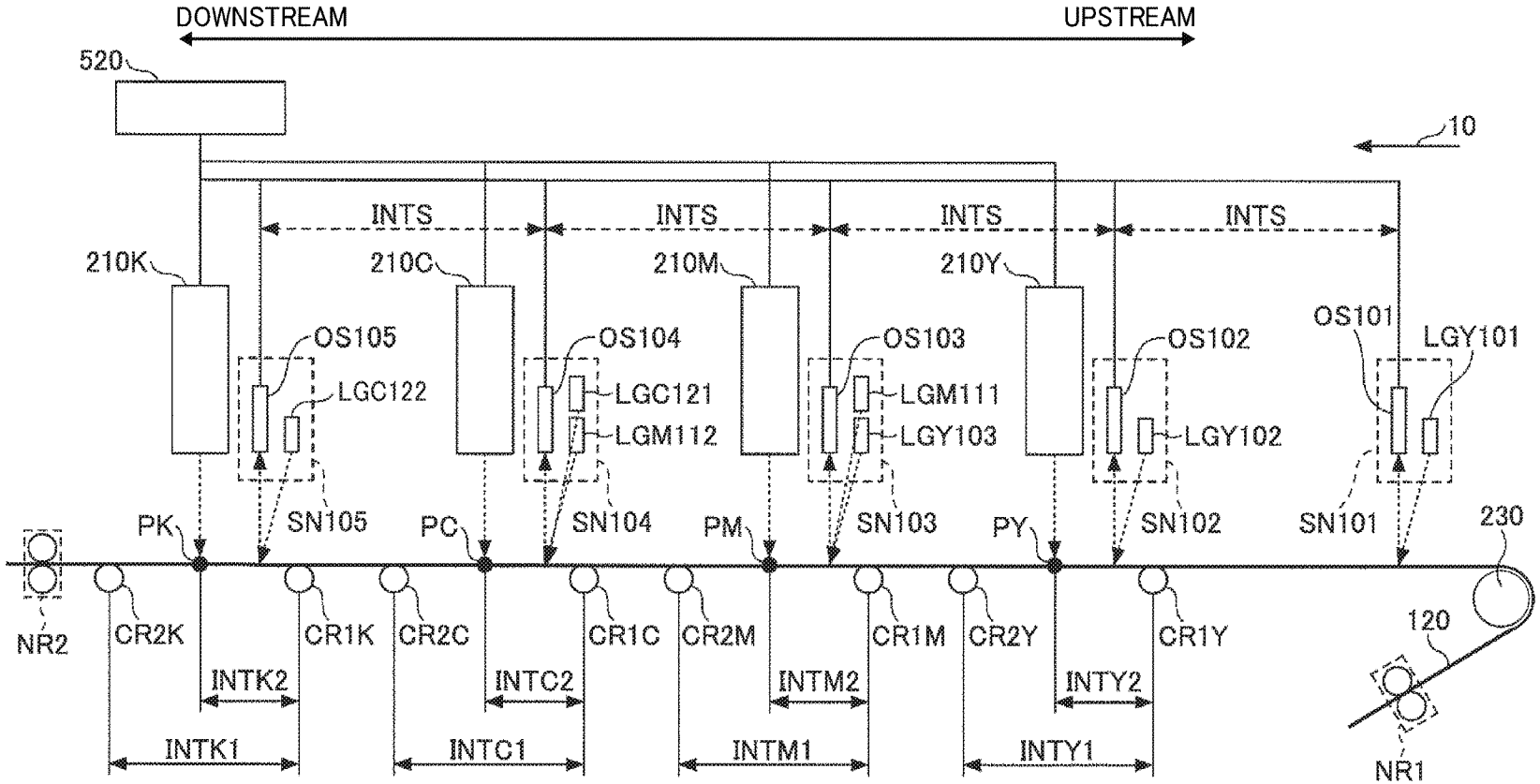
FIG. 27 is a schematic view illustrating a general structure of a liquid discharge apparatus according to Variation 3.

FIG. 27 is a schematic view illustrating a general structure of the liquid discharge apparatus according to Variation 3. In this example, the optical sensors OS located upstream from the liquid discharge head unit 210 to be controlled (in movement or discharge timing) is used for detection at two positions. Based on the detection, the liquid discharge head unit 210 is moved or the discharge timing thereof is controlled.

Specifically, a first sensor device SN101 is disposed upstream from a second sensor device SN102. The second sensor device SN102 is preferably disposed in a range extending from the yellow ink discharge position PY upstream to the first roller CR1Y for yellow (hereinafter "upstream range INTY2"). The first and second sensor devices SN101 and SN102 include optical sensors OS101 and OS102 and light sources LGY101 and LGY102, respectively. A third sensor device SN103 is preferably disposed in a range extending from the magenta ink discharge position PM upstream to the first roller CR1M for magenta (hereinafter "upstream range INTM2"). Similarly, a fourth sensor device SN104 is preferably disposed in a range extending from the cyan ink discharge position PC upstream to the first roller CR1C for cyan (hereinafter "upstream range INTC2"). Similarly, a fifth sensor device SN105 is preferably disposed in a range extending from the black ink discharge position PK upstream to the first roller CR1K for black in the conveyance direction 10 (hereinafter "upstream range INTK2"). The sensor device SN103 includes an optical sensor OS103 and light sources LGY103 and LGM111. The sensor device SN104 includes an optical sensor OS104 and light sources LGM112 and LGC121. The sensor device SN105 includes an optical sensor OS105 and a light source LGC 122.

When the sensors are respectively disposed in the upstream ranges INTK2, INTC2, INTM2, and INTY2, the image forming apparatus 110 can detect the position of the recording medium (conveyed object) in the conveyance direction 10 and the direction orthogonal thereto, with a high accuracy. The sensor thus disposed is upstream from the ink discharge position in the conveyance direction 10. Therefore, initially, on the upstream side, the sensor can accurately detect the movement amount or conveyance speed of the recording medium in the conveyance direction 10, the orthogonal direction 20, or both.

Accordingly, the image forming apparatus 110 can calculate the ink discharge timings (i.e., operation timing) of the liquid discharge head units 210, the amount by which the head units are to move, or both. In other words, in a period from when the position of the web 120 is detected on the upstream side of the ink discharge position to when the detected portion of the web 120 reaches the ink discharge position, the operation timing is calculated or the head unit is moved. Therefore, the image forming apparatus 110 can adjust the ink discharge position with high accuracy.

Note that, assuming that the location of sensor is directly below the liquid discharge head unit 210, in some cases, a delay of control action renders an image out of color registration. Accordingly, when the location of sensor is upstream from the ink discharge position, misalignment in color superimposition is suppressed, improving image quality. There are cases where layout constraints hinder disposing the sensor close to the ink discharge position. Accordingly, the location of sensor is preferably closer to the first roller CR1 than the ink discharge position.

The sensor can be disposed directly below each liquid discharge head unit 210. In the example described below, the sensor is disposed directly below the liquid discharge head unit 210. The sensor disposed directly below the head unit can accurately detect the amount of movement of the recording medium directly below the head unit. Therefore, in a configuration in which the speed of control action is relatively fast, the sensor is preferably disposed closer to the position directly below each liquid discharge head unit 210. However, the position of the sensor is not limited to a position directly below the liquid discharge head unit 210, and similar calculation is feasible when the sensor device SN is disposed otherwise.

Alternatively, in a configuration where error is tolerable, the sensor can be disposed directly below the liquid discharge head unit 210, or downstream from the position directly below the liquid discharge head unit 210 in the inter-roller range INT1.

Figure 28:
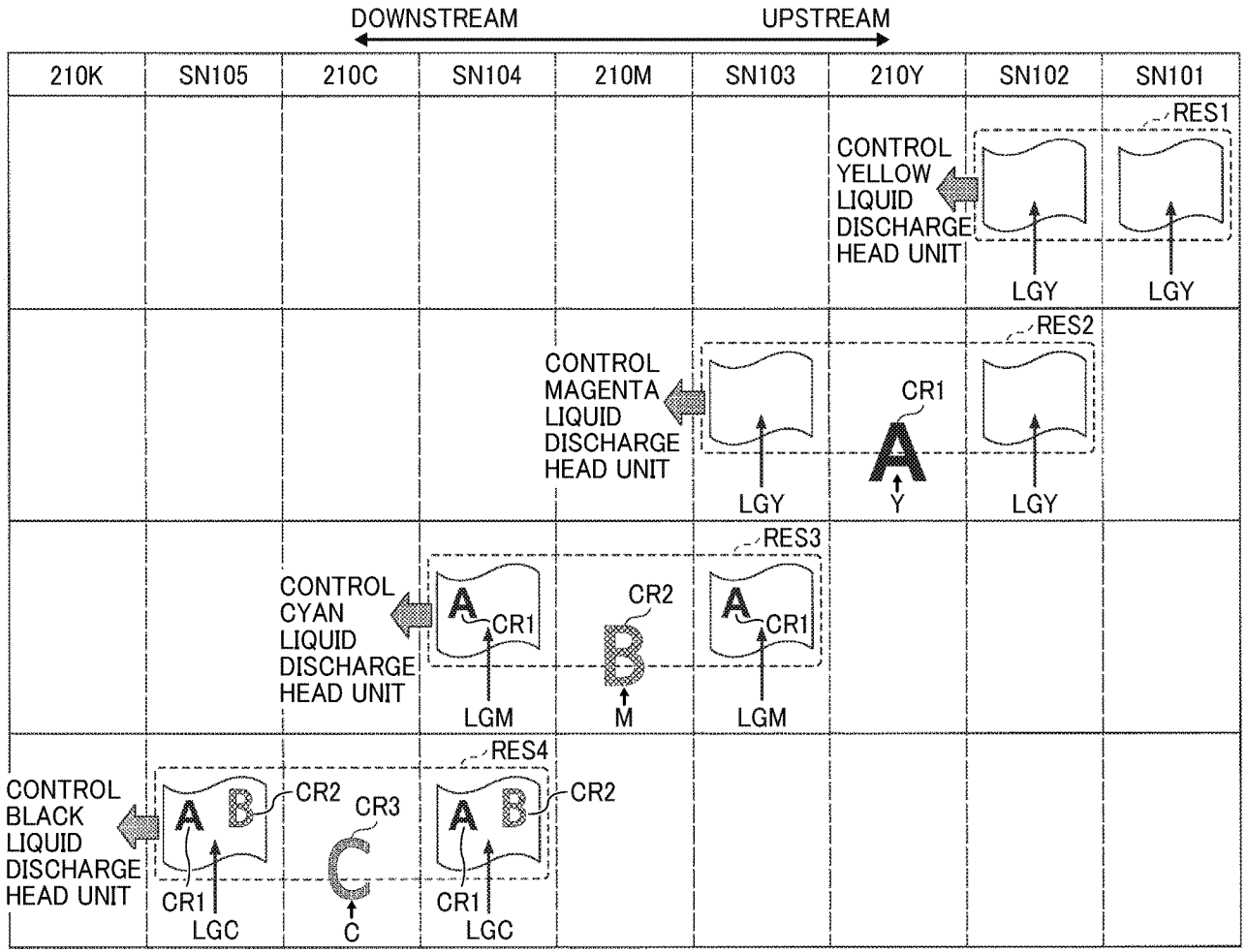
FIG. 28 illustrates detection and control according to Variation 3.

FIG. 28 illustrates detection and control according to Variation 2. In this example, using a detection result pair (i.e., a first result RES1) generated by the first sensor device SN101 and the second sensor device SN102, both disposed upstream from the yellow liquid discharge head unit 210Y in the conveyance direction 10, the image forming apparatus 110 controls the movement or discharge timing of the liquid discharge head unit 210Y.

Using a detection result pair hereinafter (i.e., a second result RES2) generated by the second sensor device SN102 and the third sensor device SN103, both disposed upstream from the magenta liquid discharge head unit 210M in the conveyance direction 10, the image forming apparatus 110 controls the movement or discharge timing of the liquid discharge head unit 210M.

Using a detection result pair a third result RES3) generated by the third sensor device SN103 and the fourth sensor device SN104, both disposed upstream from the cyan liquid discharge head unit 210C in the conveyance direction 10, the image forming apparatus 110 controls the movement or discharge timing of the liquid discharge head unit 210C.

Using a detection result pair (i.e., a fourth result RES4) generated by the fourth sensor device SN104 and a fifth sensor device SN105, both disposed upstream from the black liquid discharge head unit 210K in the conveyance direction 10, the image forming apparatus 110 controls the movement or discharge timing of the liquid discharge head unit 210K.

Figure 29:
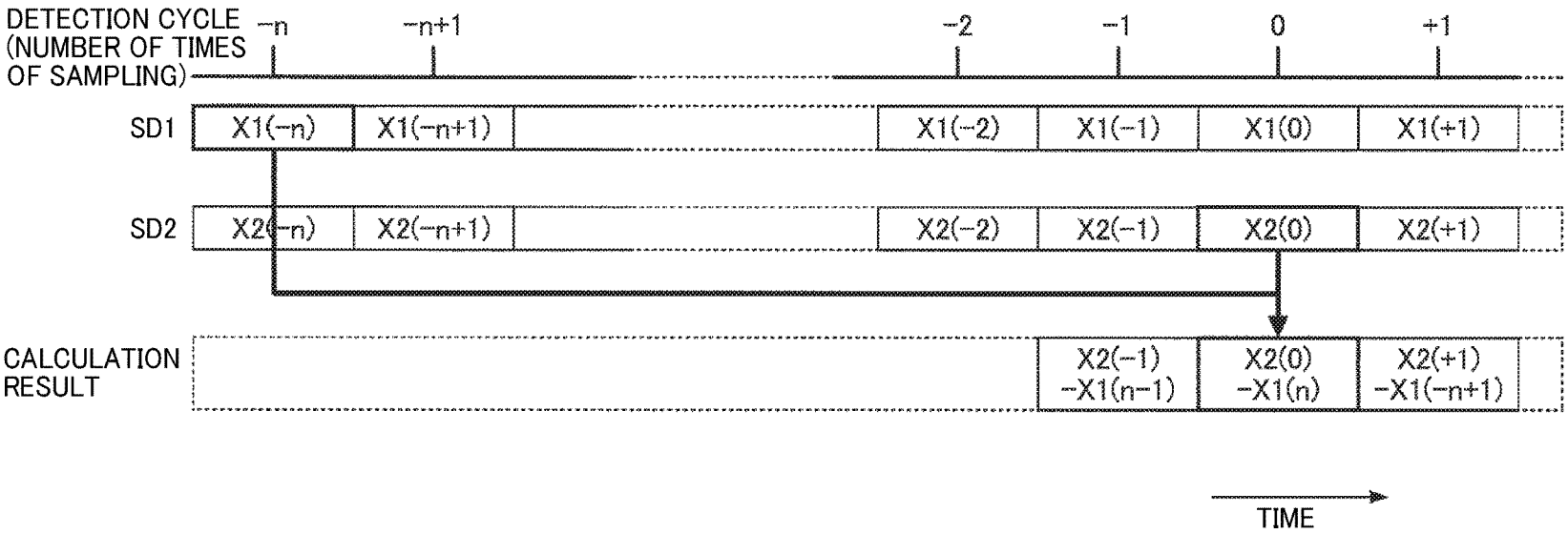
FIG. 29 is a timing chart illustrating conveyed object detection according to Variation 3.

Using the first, second, third, fourth, and fifth results RES1, RES2, RES3, RES4, and RES5, the image forming apparatus 110 performs, for example, the processing illustrated in the timing chart in FIG. 29.

In the case of the first result RES1, the first sensor device SN101 generates first sensor data SD1, and the second sensor device SN102 generates second sensor data SD2. In the case of the second result RES2, the second sensor device SN102 generates the first sensor data SD1, and the third sensor device SN103 generates the second sensor data SD2. In the case of the third result RES3, the third sensor device SN103 generates the first sensor data SD1, and the fourth sensor device SN104 generates the second sensor data SD2. In the case of the fourth result RES4, the fourth sensor device SN104 generates the first sensor data SD1, and the fifth sensor device SN105 generates the second sensor data SD2.

As illustrated in FIG. 29, the image forming apparatus 110 outputs a calculation result indicating the displacement of the web 120 or the like, based on a plurality of sensor data, namely, the first and second sensor data SD1 and SD2. When the sensor data is transmitted from the sensor device SN, the image forming apparatus 110 calculates, for each liquid discharge head unit 210, the displacement of the web 120 based on a plurality of detection results represented by the sensor data.

Descriptions are given below of calculation of displacement of the web 120 for the cyan liquid discharge head unit 210C, made based on the third result RES3.

It is assumed that the optical sensor OS103 of the third sensor device SN103 and the optical sensor OS104 of the fourth optical sensor OS104 are disposed at a distance L2 (interval) from each other. It is assumed that V represents the conveyance speed calculated based on the data generated by the optical sensors OS, and T2 represents a travel time for the web 120 (conveyed object) to be conveyed from the optical sensor OS103 to the optical sensor OS104. In this case, the travel time is calculated as "T2=L2/V".

When A represents a sampling interval of the optical sensor OS and n represents the number of times of sampling performed while the web 120 travels from one sensor to the other sensor, the number of times of sampling "n" is calculated as "n=T2/A".

The calculation result is referred to as a displacement ΔX. In a case of a detection cycle "0" in FIG. 29, the first sensor data SD1 before the travel time T2 is compared with the second sensor data SD2 at the detection cycle "0", to calculate the displacement ΔX of the web 120. This calculation is expressed as $\Delta X = X2(0) - X1(n)$.

Subsequently, the image forming apparatus 110 controls the actuator AC to move the liquid discharge head unit 210C in the orthogonal direction 20, to compensate for the displacement ΔX. With this operation, even when the position of the conveyed object changes in the orthogonal direction 20, the image forming apparatus 110 can form an image on the conveyed object with a high accuracy. Further, as the displacement is calculated based on the sensor data SD at two different positions in the conveyance direction, that is, the detection results generated by the two different optical sensors OS, the displacement of the conveyed object can be calculated without multiplying the position data of the sensor devices SN. This operation can suppress the accumulation of detection errors by the sensor devices SN.

The sensor data SD is not limited to the detection result generated by the sensor device SN next to and upstream from the liquid discharge head unit 210 in the conveyance direction 10. That is, any of the optical sensors OS upstream from the liquid discharge head unit 210 to be moved can be used.

Note that the second sensor data SD2 is preferably generated by the sensor device SN closest to the liquid discharge head unit 210 to be moved.

Alternatively, the displacement of the conveyed object can be calculated based on three or more detection results.

Thus, based on the displacement calculated based on the plurality of sensor data SD, travel of the liquid discharge head unit 210 is controlled. Then, the position of the discharged liquid on the web 120 can be controlled accurately in the orthogonal direction 20. When the discharge timing of the liquid discharge head unit 210 is controlled based on the displacement of the web 120 in the conveyance direction 10 in a similar manner, the position of the discharged liquid on the web 120 can be controlled accurately in the conveyance direction 10.

The image forming apparatus 110 further includes a head moving device 55F (in FIG. 24, such as an actuator) to move the liquid discharge head unit 210 according to the detection results. In such a configuration, the liquid discharge apparatus according to the above-described embodiment can suppress the misalignment in the droplet landing positions in the orthogonal direction 20. In particular, in liquid discharge apparatuses, image quality is improved when the liquid discharge head unit is moved to eliminate the misalignment in droplet landing positions during image formation.

The image forming apparatus 110 can further includes a measuring instrument such as an encoder. Descriptions are given below of a configuration including an encoder serving as the measuring instrument. For example, the encoder is attached to a rotation shaft of the roller 230, which is a driving roller. Then, the encoder can measure the amount of movement of the web 120 in the conveyance direction 10, based on the amount of rotation of the roller 230. When the measurement results are used in combination with the detection results generated by the sensor device SN, the image forming apparatus 110 can discharge ink to the web 120 accurately.

A liquid discharge apparatus according to an aspect of this disclosure irradiates a conveyed object, with light having a high relative intensity in a wavelength range in which relative reflectance of liquid is high, and detects an amount of movement or speed of movement of the conveyed object. When a pattern (a letter or the like) drawn with the liquid (e.g., ink) is irradiated with such light (relatively intense on the liquid), the pattern drawn with the liquid is less likely to enter the image data used in detecting the amount of movement or speed of movement of the conveyed object. Thus, adverse effects of the pattern drawn with the liquid are suppressed.

Specifically, as described above, when a light source to emit light corresponding to the color of the liquid is used, the pattern drawn with the liquid assimilates with the light. Accordingly, the pattern is not included in the image data, and adverse effect of the pattern is suppressed. Accordingly, the liquid discharge apparatus can detect the amount of movement or the speed of movement accurately with the detecting unit 52.

In a configuration in which the color of the liquid is different among the liquid discharge head units, the wavelength of the light is different among the liquid discharge head units. For example, the detecting units 52 disposed upstream and downstream from a yellow liquid discharge head unit emit yellow light and generate the image data.

In the illustrative embodiment, detection is performed on the side on which the liquid is discharged. Alternatively, for example, in a case in which the liquid is see-through on the back side of the recording medium, detection is performed on the back side while the back side is irradiated with the light. One or more aspects of this disclosure can adapt to such as configuration.

Additionally, in an image forming apparatus to discharge liquid to form images on a recording medium, as the accuracy in droplet landing positions improves, misalignment in color superimposition is suppressed, improving image quality.

Figure 30:
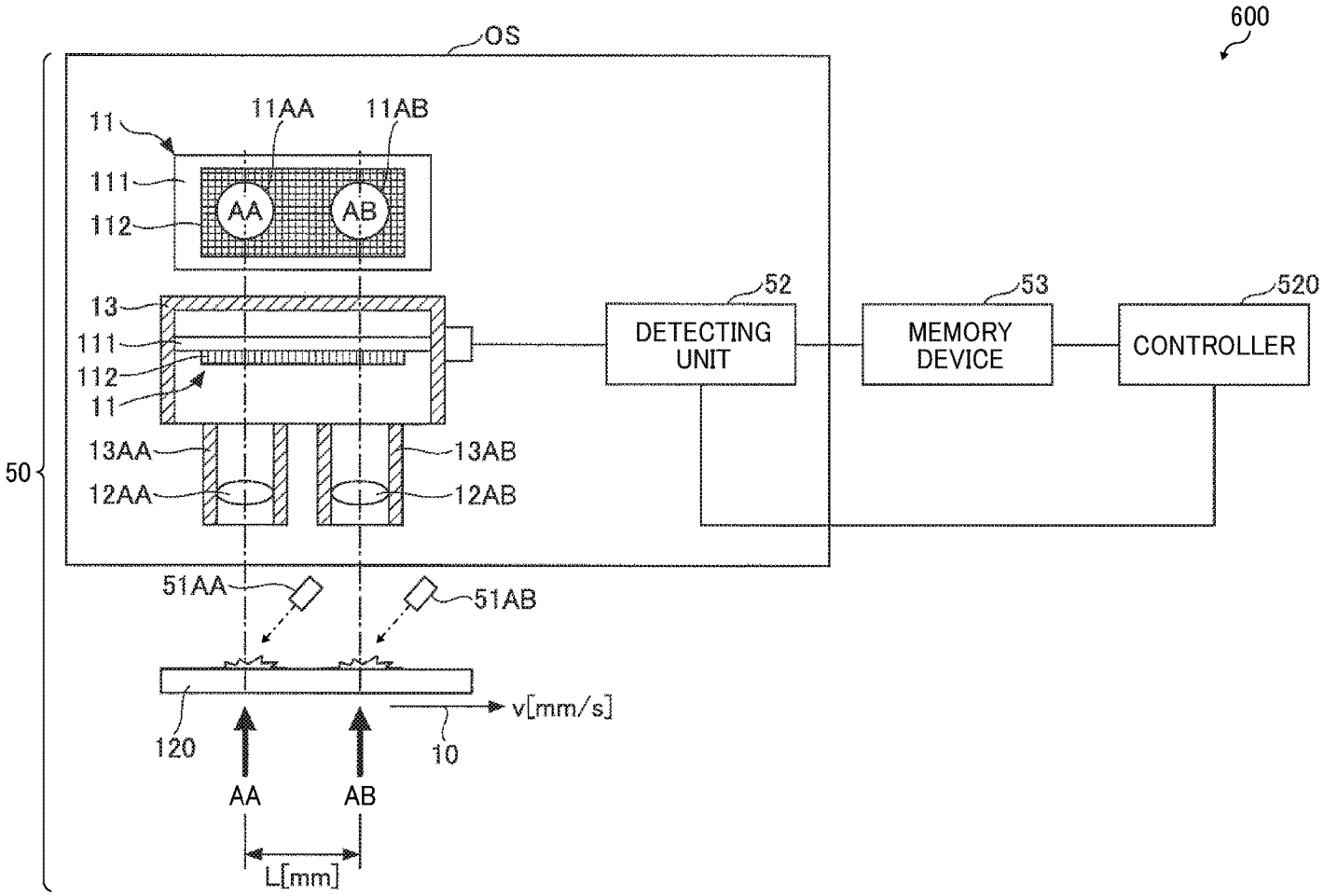
FIG. 30 is a schematic block diagram of a conveyed object detector according to a variation.

FIG. 30 is a schematic block diagram of a conveyed object detector according to a variation. For example, the conveyed object detector 600 is implemented by a sensor device 50, a first light source 51AA, a second light source 51AB, a control circuit 152, a memory device 53, and a controller 520. This configuration is different from the configuration illustrated in FIG. 11 in in the configurations of the optical sensor OS.

The first light source 51AA and the second light source 51AB emit laser light or the like to the web 120, which is an example of an object to be detected. The first light source 51AA irradiates a position AA with light, and the second light source 51AB irradiates a position AB with light.

Each of the first light source 51AA and the second light source 51AB includes a light-emitting element to emit laser light and a collimator lens to approximately collimate the laser light emitted from the light-emitting element. The first light source 51AA and the second light source 51AB are disposed to emit light in an oblique direction relative to the surface of the web 120.

The optical sensor OS includes an area sensor 11, a first imaging lens 12AA disposed opposing the position AA, and a second imaging lens 12AB disposed opposing the position AB.

The area sensor 11 includes an image sensor 112 on a silicon substrate 111. The image sensor 112 includes an area 11AA and an area 11AB, in each of which a two-dimensional image is captured. For example, the area sensor 11 is a CCD image sensor, a complementary metal oxide semiconductor (CMOS) image sensor, a photodiode array, or the like. The area sensor 11 is housed in a case 13. The first imaging lens 12AA and the second imaging lens 12AB are hold by first lens barrel 13AA and a second lens barrel 13AB, respectively.

In the illustrated structure, the optical axis of the first imaging lens 12AA matches a center of the area 11AA. Similarly, the optical axis of the second imaging lens 12AB matches a center of the area 11AB. The first imaging lens 12AA and the second imaging lens 12AB focus light on the area 11AA and the area 11AB, respectively, to generate two-dimensional image data.

In this case, the sensor device 50 can detect displacement or speed between the positions AA and AB. Further, the sensor device can perform calculation using such a detection result and a detection result generated by a sensor device disposed at a different position in the conveyance direction 10, thereby detecting the displacement and speed between the sensor devices disposed at different positions from each other. When the color of light is different between the first and second light sources 51AA and 51AB, the sensor device 50 can be used as the second, third, or fourth sensor device SN2, SN3, or SN4 in FIG. 3.

For example, the sensor device 50 can have the following structure.

Figure 31:
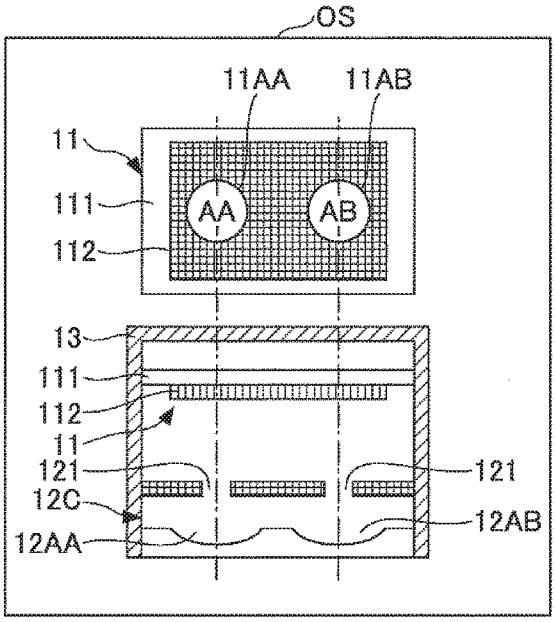
FIG. 31 is a schematic view of an optical sensor according to a variation.

FIG. 31 is a schematic block diagram of the conveyed object detector 600 according to another variation. Differently from the structure illustrated in FIG. 30, in the structure illustrated in FIG. 31, the first imaging lens 12AA and the second imaging lens 12AB are integrated into a lens 12C. The area sensor 11 and the like are similar in structure to those illustrated in FIG. 30.

Additionally, in this structure, use of an aperture 121 or the like is preferable to prevent interference between the images generated by the first imaging lens 12AA and the second imaging lens 12AB. The aperture 121 or the like can limit a range in which each of the first imaging lens 12AA and the second imaging lens 12AB generates an image. Accordingly, the interference between imaging is suppressed. Then, the optical sensor OS can generate image data at the position AA and image data at the position AB illustrated in FIG. 30.

Figure 32A:
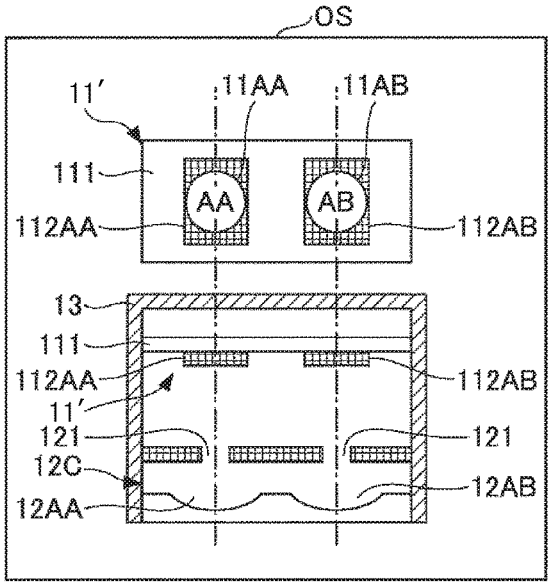
FIGS. 32A and 32B are schematic views of an optical sensor according to a variation.
Figure 32B:
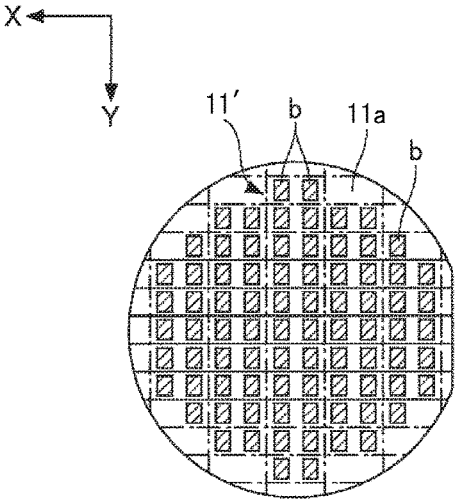

FIGS. 32A and 32B are schematic views of the optical sensor OS according to a variation. Differently from the structure illustrated in FIG. 31, the optical sensor OS illustrated in FIG. 32A includes an area sensor 11' instead of the area sensor 11. The first imaging lens 12AA, the second imaging lens 12AB, and the like are similar in structure to those illustrated in FIG. 31.

The area sensor 11' has a structure illustrated in FIG. 32B, for example. Specifically, as illustrated in FIG. 32B, a wafer 11*a* includes a plurality of image sensors b. The plurality of image sensors b illustrated in FIG. 32B is cut out of the wafer 11*a*. The image sensors b serve as a first image sensor 112AA and a second image sensor 112AB and are disposed on the silicon substrate 111. The first imaging lens 12AA and the second imaging lens 12AB are disposed in accordance with the distance between the first image sensor 112A and the second image sensor 112B.

Image sensors are generally manufactured for imaging. Therefore, image sensors have an aspect ratio (ratio between X-direction size and Y-direction size), such as square, 4:3, and 16:9, that fits an image format. In the present embodiment, image data covering at least two different points spaced apart is captured. Specifically, image data is generated at each of points spaced apart in the X direction, one direction in two dimensions. The X direction corresponds to the conveyance direction 10 illustrated in FIG. 30. By contrast, the image sensor has an aspect ratio fit for the image format. Accordingly, when image data is generated at the two points spaced apart in the X direction, it is possible that an image sensor relating to the Y direction is not used. To enhance pixel density, an image sensor having a higher pixel density is used in either the X direction or the Y direction. In such a case, the cost increases.

In view of the foregoing, in the structure illustrated in FIG. 32A, on the silicon substrate 111, the first image sensor 112AA and the second image sensor 112AB spaced apart are disposed. This structure can reduce the number of unused image sensors of the image sensors relating to the Y direction. In other words, waste of image sensors is inhibited. Additionally, since the first image sensor 112AA and the second image sensor 112AB are produced through a semiconductor process with high accuracy, the distance between the first image sensor 112AA and the second image sensor 112AB is set with high accuracy.

Figure 33:
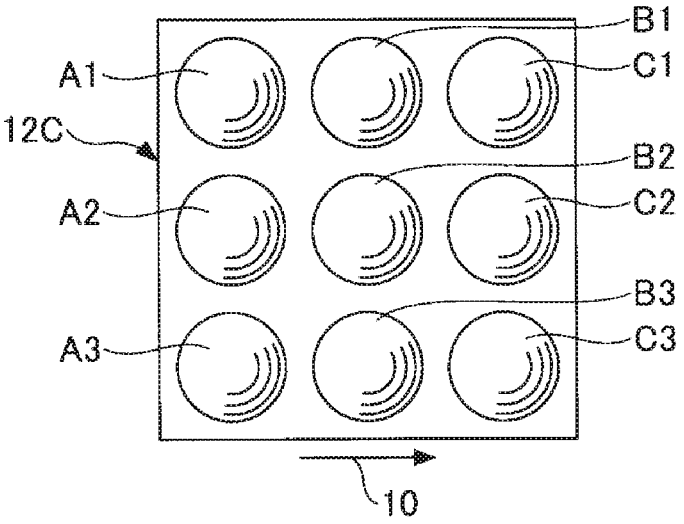
FIG. 33 is a schematic view of a plurality of imaging lenses usable for the conveyed object detector according to an embodiment.

FIG. 33 is a schematic view of a plurality of imaging lenses used for the detecting mechanism, according to an embodiment. The lens array illustrated can be used to implement the conveyed object detector.

In the lens array illustrated in FIG. 7, two or more lenses are integrated. Specifically, the lens array illustrated in FIG. 7 includes, for example, nine imaging lenses A1, A2, A3, B1, B2, B3, C1, C2, and C3 arranged in three rows and three columns. When such a lens array is used, image data including nine points is captured. In this case, an area sensor having nine imaging ranges is used.

One or more of aspects of this disclosure can adapt to a liquid discharge system including at least one liquid discharge apparatus. For example, the liquid discharge head unit 210K and the liquid discharge head unit 210C are housed in one case as one device, and the liquid discharge head unit 210M and the liquid discharge head unit 210Y are housed in another case as another device. The liquid discharge system includes the two devices.

Further, one or more of aspects of this disclosure can adapt a liquid discharge apparatus and a liquid discharge system to discharge liquid other than ink. For example, the liquid is a recording liquid of another type or a fixing solution.

The liquid discharge apparatus (or system) to which one or more of aspects of this disclosure is applicable is not limited to forming apparatus to form two-dimensional images but can be apparatuses to fabricate three-dimensional articles (3D-fabricated object).

The conveyed object is not limited to recording media such as paper sheets but can be any material to which liquid adheres, even temporarily. Examples of the material to which liquid adheres include paper, thread, fiber, cloth, leather, metal, plastic, glass, wood, ceramics, and a combination thereof.

Further, one or more of aspects of this disclosure is applicable to a method of discharging liquid from an forming apparatus, an information processing apparatus, or a computer as a combination thereof, and at least a portion of the method can be implemented by a program.

The light source is not limited to laser light sources but can be, for example, an organic electro luminescence (EL) instead of the light emitting diode (LED) described above. Depending on the light source, the pattern to be detected is not limited to the speckle pattern.

Further, aspects of this disclosure can adapt to any apparatus to perform an operation or processing on a conveyed object, using a movable head to move in the direction orthogonal to the direction of conveyance of the conveyed object. The movable head may be lined in the orthogonal direction.

For example, aspects of this disclosure can adapt to a conveyance apparatus that conveys a substrate (conveyed object) and includes a laser head to perform laser patterning on the substrate. The laser head may be lined in the direction orthogonal to the direction of conveyance of the substrate. The conveyance apparatus detects the position of the substrate and moves the head based on the detection result. In this case, the position at which the laser strikes the substrate is the operation position of the head.

The number of the head units is not necessarily to two or more. Aspects of this disclosure can adapt to a device configured to keep operation at to a reference position, on a conveyed object.

Any one of the above-described operations may be performed in various other ways, for example, in an order different from the one described above. Any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A liquid discharge apparatus comprising:

a plurality of heads disposed in a conveyance direction of a conveyed object to discharge liquids respectively onto the conveyed object;

at least one light source to irradiate the conveyed object with light having a high relative intensity in a range of wavelength in which a relative reflectance of the liquids is high, the light set to a frequency corresponding to a color spectrum off each of the liquids respectively discharged from the plurality of heads; and a detector including at least one optical sensor configured to perform imaging of the conveyed object being irradiated by the at least one light source, to generate data, the detector configured to generate a detection result based on the data, the detection result including at least one of a conveyance amount of the conveyed object and a conveyance speed of the conveyed object.

2. The liquid discharge apparatus according to claim 1, wherein the detector is configured to detect an amount of shift of a pattern on the conveyed object in a direction orthogonal to a conveyance direction of the object and generate the detection result with reference to the pattern on the conveyed object.

3. The liquid discharge apparatus according to claim 2, wherein the pattern represents interference of the light reflected on a rugged shape of the conveyed object, and the detector is configured to generate the detection result based on an image of the pattern.

4. The liquid discharge apparatus according to claim 2, wherein the at least one optical sensor is configured to perform imaging of the pattern at a plurality of different time points, and wherein the detector is configured to detect a position of the conveyed object based on the imaging of the pattern at the plurality of different time points.

5. The liquid discharge apparatus according to claim 1, wherein the at least one light source includes:

a first light source to irradiate the conveyed object at a position upstream from the plurality of heads in the conveyance direction of the conveyed object; and a second light source to irradiate the conveyed object at a position downstream from the plurality of heads in the conveyance direction, wherein the at least one optical sensor includes:

a first sensor disposed upstream from the plurality of heads in the conveyance direction, to generate first data of the conveyed being irradiated by the first light source; and a second sensor disposed downstream from the plurality of heads in the conveyance direction, to generate second data of the conveyed being irradiated by the second light source, wherein the detector is configured to generate the detection result based on the first data and the second data.

6. The liquid discharge apparatus according to claim 1, further comprising:

a first support disposed upstream from a liquid landing position in a conveyance direction of the conveyed object, the liquid landing position at which the liquid discharged from the plurality of heads lands on the conveyed object, the first support to support the conveyed object; and a second support disposed downstream from the liquid landing position in the conveyance direction, the second support to support the conveyed object, wherein the detector is disposed between the first support and the second support.

7. The liquid discharge apparatus according to claim 6, wherein the detector is disposed between the first support and the liquid landing position in the conveyance direction.

8. The liquid discharge apparatus according to claim 1, further comprising a head moving device to move the plurality of heads in an orthogonal direction orthogonal to a conveyance direction of the conveyed object based on the detection result.

9. The liquid discharge apparatus according to claim 1, further comprising a head controller configured to control the plurality of heads based on the detection result.

10. The liquid discharge apparatus according to claim 1, wherein the conveyed object is a continuous sheet.

11. The liquid discharge apparatus according to claim 1, wherein the plurality of heads form an image with the liquid on the conveyed object.

12. The liquid discharge apparatus according to claim 1, wherein the detector is disposed opposing a surface of the conveyed object onto which the liquid is discharged.

13. A system comprising:

the liquid discharge apparatus according to claim 1; and a host configured to input data and control data to the liquid discharge apparatus.

14. A liquid discharge apparatus comprising:

a plurality of heads to discharge liquids respectively onto a conveyed object, the plurality of heads configured to move in an orthogonal direction orthogonal to a conveyance direction of the conveyed object;

a first light source disposed upstream from the at least one head in the conveyance direction, to irradiate the conveyed object with light set to a frequency corresponding to a color spectrum of each of the liquids respectively discharged from the plurality of heads;

a second light source disposed downstream from the at least one head of the plurality of heads in the conveyance direction, to irradiate the conveyed object with light having a high relative intensity in a range of wavelength in which a relative reflectance of the liquids is high, the light set for each of the liquids respectively discharged from the plurality of heads; and a detector including:

a first optical sensor configured to perform imaging of the conveyed object being irradiated by the first light source, to generate first data; and a second optical sensor configured to perform imaging of the conveyed object being irradiated by the second light source, to generate second data, wherein the detector is configured to generate a detection result based on the first data and the second data, the detection result including at least one of a conveyance amount of the conveyed object and a conveyance speed of the conveyed object.

15. A liquid discharging method comprising:

discharging liquids onto a conveyed object;

irradiating the conveyed object with light having a high relative intensity in a range of wavelength in which a relative reflectance of the liquid is high, the light set to a frequency corresponding to a color spectrum off each of the liquids respectively discharged from the plurality of heads off each of the liquids respectively discharged from a plurality of heads;

generating data of an irradiated portion of the conveyed object; and generating a detection result based on the data, the detection result including at least one of a conveyance amount of the conveyed object and conveyance speed of the conveyed object.

16. The liquid discharge apparatus according to claim 1, wherein the at least one light source uses light source elements of color lights that are the same as colors of the liquids discharged from the plurality of heads.

* * * * *